US012460492B1

(12) United States Patent
Gibson et al.

(10) Patent No.: US 12,460,492 B1
(45) Date of Patent: Nov. 4, 2025

(54) DOWNHOLE COMPLETION ASSEMBLY AND RELATED SYSTEMS AND METHODS OF USE

(71) Applicant: The WellBoss Company, LLC, Houston, TX (US)

(72) Inventors: Chad Michael Erick Gibson, The Woodlands, TX (US); Ryan Patrick Malone, Houston, TX (US)

(73) Assignee: The WellBoss Company, LLC, Houston, TX (US)

( * ) Notice: Subject to any disclaimer, the term of this patent is extended or adjusted under 35 U.S.C. 154(b) by 0 days.

(21) Appl. No.: 19/183,514

(22) Filed: Apr. 18, 2025

Related U.S. Application Data

(60) Provisional application No. 63/677,880, filed on Jul. 31, 2024, provisional application No. 63/641,792, filed on May 2, 2024.

(51) Int. Cl.
*E21B 23/04* (2006.01)

(52) U.S. Cl.
CPC ..... *E21B 23/0414* (2020.05)

(58) Field of Classification Search
CPC ..... E21B 23/0414
See application file for complete search history.

(56) References Cited

U.S. PATENT DOCUMENTS 3,233,674 A * 2/1966 Leutwyler ..... E21B 47/14 166/66.4
6,257,331 B1 * 7/2001 Blount ..... E21B 23/0414 166/123
7,017,672 B2 3/2006 Owen, Sr.
9,810,035 B1 11/2017 Carr et al.
10,443,331 B1 10/2019 Andres et al.
11,053,760 B2 7/2021 Baker et al.
11,371,305 B2 6/2022 Mickey et al.
11,441,374 B2 * 9/2022 Xu ..... E21B 23/0414
11,542,765 B2 1/2023 Coronado et al.
11,952,849 B2 4/2024 Gleason
12,221,845 B2 2/2025 Robicheaux et al.
2016/0265305 A1 9/2016 Davies et al.
2020/0157915 A1 * 5/2020 Hern ..... E21B 23/01
2020/0277838 A1 * 9/2020 Hern ..... E21B 23/0412
2021/0040805 A1 * 2/2021 Kehoe ..... E21B 23/04
2021/0062599 A1 * 3/2021 Coon ..... E21B 34/142
2021/0108475 A1 * 4/2021 Covalt ..... E21B 23/0417
2021/0172275 A1 6/2021 Slup et al.
2021/0355775 A1 * 11/2021 Xu ..... E21B 23/0411
2022/0034181 A1 * 2/2022 Coronado ..... E21B 23/0414
2024/0018837 A1 * 1/2024 Eitschberger ..... E21B 23/0417
2024/0218755 A1 * 7/2024 Morrison ..... E21B 36/04

* cited by examiner

*Primary Examiner* — Shane Bomar
(74) *Attorney, Agent, or Firm* — Kearney, McWilliams & Davis, PLLC; John M. DeBoer

(57) ABSTRACT

A completion assembly suitable for use in a wellbore, the completion assembly having a power charge mandrel engaged with a downhole tool in a run-in configuration. A power charge or other pyro-technique is disposed in the power charge mandrel in a run-in configuration. Fluid pressure created or increased in the power charge mandrel is conveyed to the downhole tool in a manner that results in movement of the completion assembly to a disconnected configuration. In the disconnected configuration the power charge mandrel is disengaged from the downhole tool, and the power charge mandrel is retrievable out of the wellbore.

20 Claims, 13 Drawing Sheets

200
210
288
206
208
202
222
214
F
217
278
233

222
220
205
201
212
200
258
208
207
220
S
288
205
212

319a
305
361
324
320
365
330
317a
384
301
$W_F$
333
378
306
371

304a
319
300
367
307
366
368
388
323
314
F
341
337
348
M
379
384
380
312
346
350
358
347
360
304
323
302
386
385
S
339
387
308
383
378a
310
317
R

DOWNHOLE COMPLETION ASSEMBLY AND RELATED SYSTEMS AND METHODS OF USE

STATEMENT REGARDING FEDERALLY SPONSORED RESEARCH OR DEVELOPMENT

Not applicable.

BACKGROUND

Field of the Disclosure

This disclosure generally relates to downhole tools and related systems and methods used in oil and gas wellbores. More specifically, the disclosure relates to a downhole system and completion assembly that may be run into a wellbore and useable for wellbore isolation, and methods pertaining to the same. In particular embodiments, the downhole system may include a completion assembly that may have a first sub and a second sub.

Background of the Disclosure

An oil or gas well includes a wellbore extending into a subterranean formation at some depth below a surface (e.g., Earth's surface), and is usually lined with a tubular, such as casing, to add strength to the well. Many commercially viable hydrocarbon sources are found in "tight" reservoirs, which means the target hydrocarbon product may not be easily extracted. The surrounding formation (e.g., shale) to these reservoirs typically has low permeability, and it is uneconomical to produce the hydrocarbons (i.e., gas, oil, etc.) in commercial quantities from this formation without the use of drilling accompanied with fracing operations.

Fracing now has a significant presence in the industry, and is commonly understood to include the use of some type of plug set in the wellbore below or beyond the respective target zone, followed by pumping or injecting high pressure frac fluid into the zone. For economic reasons, fracing (and any associated or peripheral operation) is now ultra-competitive, and in order to stay competitive innovation is paramount. A frac plug and accompanying operation may be such as described or otherwise disclosed in U.S. Pat. No. 8,955,605, incorporated by reference herein in its entirety for all purposes.

FIG. 1 illustrates a conventional plugging system 100 that includes use of a downhole tool 102 used for plugging a section of the wellbore 106 drilled into formation 110. The tool or plug 102 may be lowered into the wellbore 106 by way of workstring 112 (e.g., e-line, wireline, coiled tubing, etc.) and/or with setting tool 117, as applicable. The tool 102 generally includes a body 103 with a compressible seal member 122 to seal the tool 102 against an inner surface 107 of a surrounding tubular, such as casing 108. The tool 102 may include the seal member 122 disposed between one or more slips 109, 111 that are used to help retain the tool 102 in place.

In operation, forces (usually axial relative to the wellbore 106) are applied to the slip(s) 109, 111 and the body 103. As the setting sequence progresses, slip 109 moves in relation to the body 103 and slip 111, the seal member 122 is actuated, and the slips 109, 111 are driven against corresponding conical surfaces 104. This movement axially compresses and/or radially expands the compressible member 122, and the slips 109, 111, which results in these components urged outward from the tool 102 to contact the inner wall 107.

In this manner, the tool 102 provides a seal expected to prevent transfer of fluids from one section 113 of the wellbore across or through the tool 102 to another section 115 (or vice versa, etc.), or to the surface. Tool 102 may also include an interior passage (not shown) that allows fluid communication between section 113 and section 115 when desired by the user. Oftentimes multiple sections are isolated by way of one or more additional plugs (e.g., 102A).

The setting tool 117 is incorporated into the workstring 112 along with the downhole tool 102. Examples of conventional setting tools include the Baker #10 and #20, and the 'Owens Go'

Conventional, and even modern, tools require an amount of materials and components that still result in a set tool being in excess of twelve inches. A shorter tool means less materials, less parts, reduced removal time, and easier to deploy. Also by convention, it remains that one type of company is known to provide a working setting tool, while another type of company is known to provide a downhole tool. Putting these two together for the downhole environment is usually done by way of an adapter kit or the like. This leaves end users trying to mate a setting tool made by one company with a downhole tool made by another company, with neither of these tools being made with each other specifically in mind.

Because legacy setting tools like Baker 20 are made to be generic (usable with many tools via an adapter kit), they have not changed in a manner that accommodates rapid change and advancement in corresponding downhole tool (s). These setting tools use numerous parts and sealings that all are subject to failure (hence increased risk) over time; all require constant redress and/or maintenance. These setting tools use additional parts, such as a barrel piston and a setting sleeve, to convert hydraulic force (via increased gas pressure) to mechanical force (pushing the setting sleeve against the downhole tool).

Accordingly, there are needs in the art for novel systems and methods for isolating wellbores in a fast, viable, and economical fashion. There is a great need in the art for downhole plugging tools that form a reliable and resilient seal against a surrounding tubular that use less materials, less parts, have reduced or eliminated removal time, and are easier to deploy, even in the presence of extreme wellbore conditions. There is a need in the art to avoid use of a conventional setting tool kit or adapter, and instead provide end users with a combination completion assembly (which may already be pre-assembled). Other needs include an improved completion assembly that is one or more of shorter, simpler, less (or no) moving parts, lighter, cheaper, either reusable or disposable, and/or can convey a hydraulic force directly to the downhole tool.

SUMMARY

Embodiments of the disclosure pertain to a completion assembly (and related systems and methods) for use in a wellbore. The completion assembly may be a combination of one or more portions or subs. For example, the completion assembly may have a first portion (also, upper/top portion, retrievable portion, first sub [subassembly], etc.). The completion assembly may have a second portion (also, lower/bottom portion, disconnected portion, second sub, etc.). The second portion may be any type of downhole tool (for example, a frac plug).

Such downhole tools may include a number of components, such as a mandrel having a distal end; a proximate end; and an outer surface. Any number of components may be disposed around the mandrel. For example, one or more of: a seal element, a slip, a bearing ring, an expansion ring, a lower sleeve or shoe, and so forth.

Any component of the first or second portion may be made of a composite material, a metallic material, a reactive material, poly-(PGA, etc.) material, plastic material, corrodible material, etc. and combinations thereof. The material may be dissolvable, or otherwise reactive to surrounding materials (such as wellbore fluid).

Embodiments herein provide for a completion assembly for use in a wellbore. The completion assembly may have a first sub and a second sub. The first sub and the second sub may be at least partially engaged in a run-in configuration, and may be at least partially disconnected or disengaged in a disconnected configuration. The completion assembly may be engaged with a workstring (such as wireline or the like) when run or deployed into the wellbore.

In the run-in configuration the second sub may be configured to maintain integrity of a primary pressure chamber disposed at least partially within the first sub, the second sub, or both.

The first sub may be configured to convey a non-mechanical force to the second sub. The non-mechanical force (such as from fluid [gas] pressure) may be used to move the completion assembly from the run-in configuration to the disconnected configuration. The completion assembly may move from the run-in configuration to a set configuration, which may have a range of position motion associated therewith.

Any portion of the first sub that remains engaged with the workstring may be retrievable out of the wellbore in the disconnected configuration. Also in the disconnected configuration an at least a portion of the second sub remains in the wellbore. The second sub may be used in support of an at least one downhole operation that occurs after the first sub is retrieved out of the wellbore (for example, hydraulic fracturing or other type of pressure isolation function).

Embodiments herein provide for a completion assembly for use in a wellbore that may include the first sub coupled with the second sub in a run-in configuration. In the run-in configuration the second sub is configured to maintain integrity of an atmospheric pressure chamber disposed at least partially within the second sub. The completion assembly may be void of any components of a conventional setting tool, such as a setting tool adapter or adapter kit, a barrel piston, and a setting sleeve.

Other embodiments of the disclosure may provide for a downhole setting system for use in a wellbore that may include a completion assembly having a first sub; and a second sub comprising a component having a working surface, the second sub engaged with the first sub in a run-in configuration.

In a disconnected configuration the first sub may be disengaged from the second sub, and thereafter first sub may be retrievable out of the wellbore without at least a portion of the second sub. In the disconnected configuration the working surface may not be retrieved out of the wellbore.

Yet other embodiments herein may provide for a downhole setting system for use in a wellbore. The system may have a completion assembly configured with a first sub; and a second sub engaged with the first sub (suitable for use in the wellbore, such as in a run-in configuration). In the run-in configuration the completion assembly may include an inner chamber maintained at a first pressure that is isolated from an external wellbore pressure as the completion assembly is run into the wellbore.

Still other embodiments of the disclosure herein may provide for a downhole setting system for use in a wellbore that may include a completion assembly operable in an at least one configuration comprising: a run-in configuration, a set configuration, a disconnected configuration, and combinations thereof.

In the run-in configuration the completion assembly may have an inner chamber maintained at a first pressure that is isolated from an external pressure (such a from fluid in the wellbore, tubular, etc.) as the completion assembly is run into the wellbore. In the disconnected configuration the inner chamber may no longer be isolated from the external wellbore pressure.

Other embodiments of the disclosure pertain to a downhole setting system for use in a wellbore that may include a workstring; a power charge mandrel coupled to the workstring; and a downhole tool coupled with the power charge mandrel. The power charge mandrel may be retrievable with the workstring. The downhole tool may be coupled with the power charge mandrel in a run-in configuration. The downhole tool may be disconnected from the power charge mandrel in a set or disconnected configuration. A completion assembly may be coupled with the workstring, whereby the completion assembly includes the power charge mandrel coupled with the downhole tool.

The completion assembly may be pre-assembled, which is to say the power charge mandrel and the downhole tool may be coupled together prior to use or delivery to an end user. The pre-assembly may occur, for example, in a shop environment or some other suitable location. The pre-assembly may occur more than 0.5 miles from a wellhead. As measured from a point of original of pre-assembly to final delivery destination, the range of distance may be about 0.25 miles to about 10,000 miles. In other embodiments, the completion assembly may be (pre) assembled at the wellhead or other point of delivery.

The power charge mandrel may include a first power charge mandrel end and a second power charge mandrel end. A power charge or other type of ignitable material suitable to create (gas) pressure may be disposed within the power charge mandrel.

The power charge mandrel may be configured to pass a (gas/fluid/hydraulic) pressure to the downhole tool. In aspects, the (non-mechanical) pressure may act directly onto and/or against a working surface of the downhole tool. In a run-in configuration the working surface (and the downhole tool) may be coupled with the power charge mandrel. In another configuration (such as a set or disconnected configuration), the working surface may be disconnected from the power charge mandrel, and remain downhole with an at least one component of the (set) downhole tool (which may be for a period of time, random or known).

Any completion assembly of embodiments herein may have an isolation device and/or an isolation device sea. The device/seat may be disposed at least partially within or in direct proximity to any inner chamber in the run-in configuration. For example, this may be such that the isolation device and the isolation device seat may each or both be isolated from the external wellbore pressure as the completion assembly is run into the wellbore.

Any completion assembly embodiment herein in the run-in configuration may have a second pressure chamber maintained at a respective pressure (e.g., atmospheric) that may also isolated from the external wellbore pressure as the completion assembly is run into the wellbore.

Any second pressure chamber may be formed between a pair of seal rings separated by a chamber length of at least 0.2 inches to no more than 10 inches.

Any completion assembly embodiment herein in the run-in configuration may be void of any of: a setting tool adapter or adapter kit, a barrel piston, and a setting sleeve. In aspects, the assembly may be void of each of: a setting tool adapter or adapter kit, a barrel piston, and a setting sleeve.

Any completion assembly embodiment herein may have the first sub that includes a power charge mandrel, and the second sub that includes a downhole tool (such as a frac plug). The power charge mandrel may be engaged with the downhole tool via a mating feature in the run-in configuration. The mating feature may be broken, sheared, disconnected, etc. when the completion assembly moves to the disconnected configuration.

Any completion assembly embodiment herein may have the second sub configured with a working surface. The working surface may be directly contacted by pressure/force conveyed from the first sub.

Any completion assembly of embodiments herein may have the first sub configured with an inner bore or chamber in fluid communication with a pressure chamber. The pressure chamber may be a region or space that changes volume over time, such as when the completion assembly moves from the run-in configuration to another configuration.

Any completion assembly of embodiments herein may have the second sub configured with a (tool) mandrel. The mandrel is not limited to any particular shape. The mandrel may have a distal end; a proximate end; an inner flowbore; and an outer surface.

Any completion assembly of embodiments herein may be pre-assembled, whereby the first sub is engaged with the second sub prior to use in the field. Pre-assembly may occur at any location, such as at the wellhead or in a shop environment. In aspects, the first sub and the second sub may be pre-assembled engaged together at a location measured by a straight-line distance range of at least 0.5 miles to no more than 10,000 miles away from a wellhead associated with the wellbore.

Any completion assembly of the disclosure may be have one or more components may be made of any desired material. For example, one or more components may be made of: a reactive material, a composite plastic material, a hard metal material (such as cast iron), a soft metal material (such as magnesium), a corrodible material, a dissolvable material, etc., and combinations thereof.

Any completion assembly of embodiments herein may have an inner pressure chamber maintained at a first pressure that is isolated from external wellbore pressure as the completion assembly is run into the wellbore. The first sub and/or second sub may be configured to facilitate the isolation of the first pressure from the external wellbore pressure in the run-in configuration (such as via one or more seal rings therebetween).

Any completion assembly of embodiments herein may have at least one component of the second sub engaged with a tubular or other surrounding surface in the wellbore in the disconnected configuration. The engagement may be for any amount of period of time. The period of time need not be indefinitely or permanent.

Any component of the completion assembly embodiments herein may be engaged, for a limited duration, such as at least 12 hours to no more than 500 days.

Any completion assembly of embodiments herein may be void any moving parts or components normally associated with conventional setting tools that used in moving the second sub from the run-in configuration to a set configuration.

Any completion assembly of embodiments herein may use a power charge suitable to create or increase a fluid pressure. The assembly may be configured to convey the fluid pressure to an intended target, such as a working surface. In this respect, the fluid pressure may directly impact on the working surface.

Any completion assembly of embodiments herein may use a non-mechanical force to move the completion assembly from the run-in configuration to the disconnected configuration. The non-mechanical force may impact directly against a working surface that remains in the wellbore in the disconnected configuration.

Any completion assembly of embodiments herein may have the first sub include a power charge mandrel.

Any completion assembly of embodiments herein may have the second sub include a downhole tool.

These and other embodiments, features and advantages will be apparent in the following detailed description and drawings.

BRIEF DESCRIPTION OF THE DRAWINGS

A full understanding of embodiments disclosed herein is obtained from the detailed description of the disclosure presented herein below, and the accompanying drawings, which are given by way of illustration only and are not intended to be limitative of the present embodiments, and wherein.

DETAILED DESCRIPTION

Figure 1:
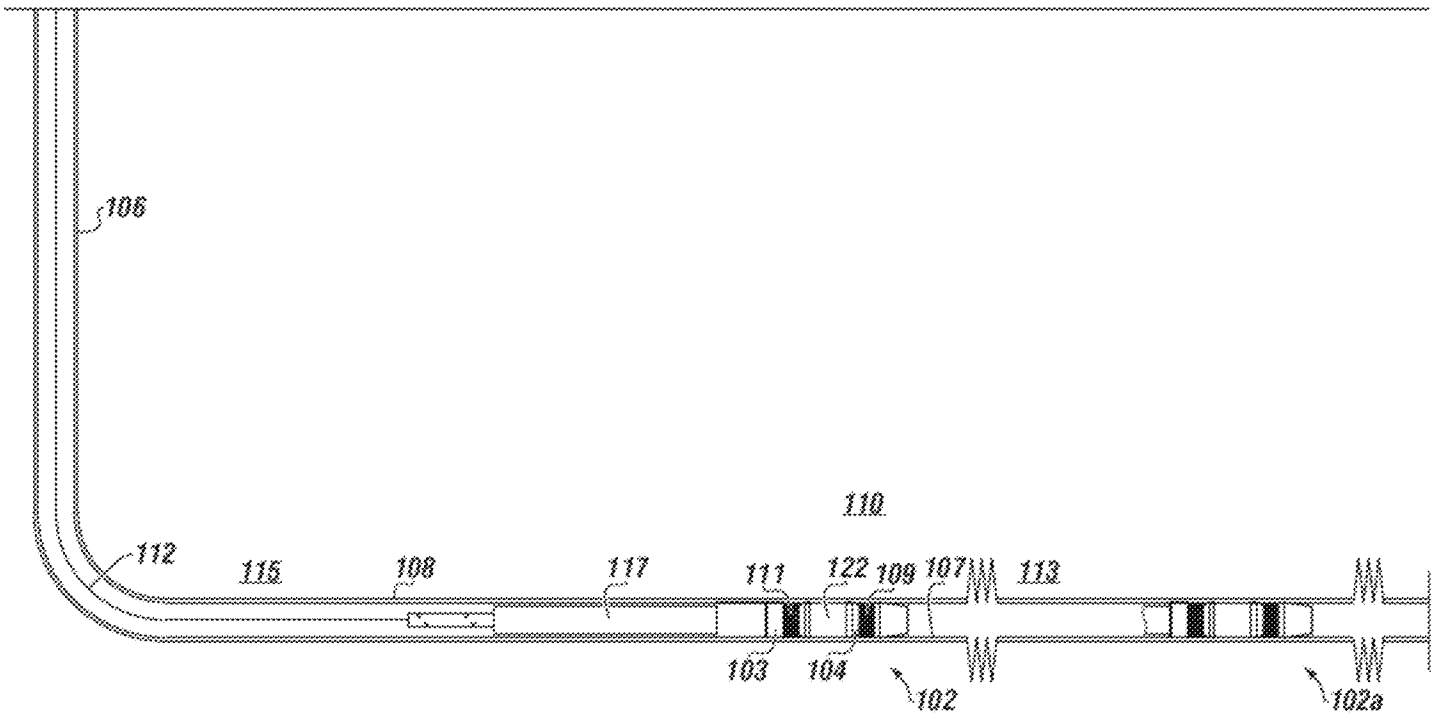
FIGURE 1 (PRIOR ART)
FIG. 1 is a side view of a process diagram of a conventional plugging system.

Herein disclosed are novel apparatuses, assemblies, tools, systems, methods, etc. that pertain to and are usable for wellbore operations, details of which are described herein.

Embodiments of the present disclosure are described in detail in a non-limiting manner with reference to the accompanying Figures. In the following discussion and in the claims, the terms "including" and "comprising" are used in an open-ended fashion, such as to mean, for example, "including, but not limited to . . . ". While the disclosure may be described with reference to relevant apparatuses, systems, and methods, it should be understood that the disclosure is not limited to the specific embodiments shown or described. Rather, one skilled in the art will appreciate that a variety of configurations may be implemented in accordance with embodiments herein.

Although not necessary, like elements in the various figures may be denoted by like reference numerals for consistency and ease of understanding. Numerous specific details are set forth in order to provide a more thorough understanding of the disclosure; however, it will be apparent to one of ordinary skill in the art that the embodiments disclosed herein may be practiced without these specific details. In other instances, well-known features have not been described in detail to avoid unnecessarily complicating the description. Directional terms, such as "above," "below," "upper," "lower," "front," "back," "right", "left", "down", etc., are used for convenience and to refer to general direction and/or orientation, and are only intended for illustrative purposes only, and not to limit the disclosure.

Connection(s), couplings, or other forms of contact between parts, components, and so forth may include conventional items, such as lubricant, additional sealing materials, such as a gasket between flanges, PTFE between threads, and the like. The make and manufacture of any particular component, subcomponent, etc., may be as would be apparent to one of skill in the art, such as molding, forming, press extrusion, machining, or additive manufacturing. Embodiments of the disclosure provide for one or more components that may be new, used, and/or retrofitted.

Various equipment may be in fluid communication directly or indirectly with other equipment. Fluid communication may occur via one or more transfer lines and respective connectors, couplings, valving, and so forth. Fluid movers, such as pumps, may be utilized as would be apparent to one of skill in the art.

Numerical ranges in this disclosure may be approximate, and thus may include values outside of the range unless otherwise indicated. Numerical ranges include all values from and including the expressed lower and the upper values, in increments of smaller units. As an example, if a compositional, physical or other property, such as, for example, molecular weight, viscosity, temperature, pressure, distance, melt index, etc., is from 100 to 1,000, it is intended that all individual values, such as 100, 101, 102, etc., and sub ranges, such as 100 to 144, 155 to 170, 197 to 200, etc., are expressly enumerated. It is intended that decimals or fractions thereof be included. For ranges containing values which are less than one or containing fractional numbers greater than one (e.g., 1.1, 1.5, etc.), smaller units may be considered to be 0.0001, 0.001, 0.01, 0.1, etc. as appropriate. These are only examples of what is specifically intended, and all possible combinations of numerical values between the lowest value and the highest value enumerated, are to be considered to be expressly stated in this disclosure. Others may be implied or inferred.

Embodiments herein may be described at the macro level, especially from an ornamental or visual appearance. Thus, a dimension, such as length, may be described as having a certain numerical unit, albeit with or without attribution of a particular significant figure. One of skill in the art would appreciate that the dimension of "2 centimeters" may not be exactly 2 centimeters, and that at the micro-level may deviate. Similarly, reference to a "uniform" dimension, such as thickness, need not refer to completely, exactly uniform. Thus, a uniform or equal thickness of "1 millimeter" may have discernable variation at the micro-level within a certain tolerance (e.g., 0.001 millimeter) related to imprecision in measuring and fabrication.

Terms

The term "connected" as used herein may refer to a connection between a respective component (or subcomponent) and another component (or another subcomponent), which can be fixed, movable, direct, indirect, and analogous to engaged, coupled, disposed, etc., and can be by screw, nut/bolt, weld, and so forth. Any use of any form of the terms "connect", "engage", "couple", "attach", "mount", etc. or any other term describing an interaction between elements is not meant to limit the interaction to direct interaction between the elements and may also include indirect interaction between the elements described.

The term "fluid" as used herein may refer to a liquid, gas, slurry, multi-phase, etc. and is not limited to any particular type of fluid such as hydrocarbons.

The term "fluid connection", "fluid communication," "fluidly communicable," and the like, as used herein may refer to two or more components, systems, etc. being coupled whereby fluid from one may flow or otherwise be transferrable to the other. The coupling may be direct or indirect. For example, valves, flow meters, pumps, mixing tanks, holding tanks, tubulars, separation systems, and the like may be disposed between two or more components that are in fluid communication.

The term "pipe", "conduit", "line", "tubular", or the like as used herein may refer to any fluid transmission means, and may be tubular in nature.

The term "composition" or "composition of matter" as used herein may refer to one or more ingredients, components, constituents, etc. that make up a material (or material of construction). Composition may refer to a flow stream, or the material of construction of a component of a downhole tool, of one or more chemical components.

The term "chemical" as used herein may analogously mean or be interchangeable to material, chemical material, ingredient, component, chemical component, element, substance, compound, chemical compound, molecule(s), constituent, and so forth and vice versa. Any 'chemical' discussed in the present disclosure need not refer to a 100% pure chemical. For example, although 'water' may be thought of as H2O, one of skill would appreciate various ions, salts, minerals, impurities, and other substances (including at the ppb level) may be present in 'water'. A chemical may include all isomeric forms and vice versa (for example, "hexane", includes all isomers of hexane individually or collectively).

The term "pump" as used herein may refer to a mechanical device suitable to use an action such as suction or pressure to raise or move liquids, compress gases, and so forth. 'Pump' can further refer to or include all necessary subcomponents operable together, such as impeller (or vanes, etc.), housing, drive shaft, bearings, etc. Although not always the case, 'pump' can further include reference to a driver, such as an engine and drive shaft. Types of pumps include gas powered, hydraulic, pneumatic, and electrical.

The term "frac operation" as used herein may refer to fractionation of a downhole well that has already been drilled. 'Frac operation' can also be referred to and interchangeable with the terms fractionation, hydrofracturing, hydrofracking, fracking, fracing, frac, and the like. A frac operation can be land or water based.

The term "mounted" as used herein may refer to a connection between a respective component (or subcomponent) and another component (or another subcomponent), which can be fixed, movable, direct, indirect, and analogous to engaged, coupled, disposed, etc., and can be by screw, nut/bolt, weld, and so forth.

The term "reactive material" as used herein may refer a material with a composition of matter having properties and/or characteristics that result in the material responding to a change over time and/or under certain conditions. The term reactive material may encompass degradable, dissolvable, disassociatable, dissociable, and so on.

The term "degradable material" as used herein may refer to a composition of matter having properties and/or characteristics that, while subject to change over time and/or under certain conditions, lead to a change in the integrity of the material. As one example, the material may initially be hard, rigid, and strong at ambient or surface conditions, but over time (such as within about 12-36 hours) and under certain conditions (such as wellbore conditions), the material softens.

The term "dissolvable material" may be analogous to degradable material. The term as used herein may refer to a composition of matter having properties and/or characteristics that, while subject to change over time and/or under certain conditions, lead to a change in the integrity of the material, including to the point of degrading, or partial or complete dissolution. As one example, the material may initially be hard, rigid, and strong at ambient or surface conditions, but over time (such as within about 12-36 hours) and under certain conditions (such as wellbore conditions), the material softens. As another example, the material may initially be hard, rigid, and strong at ambient or surface conditions, but over time (such as within about 12-36 hours) and under certain conditions (such as wellbore conditions), the material dissolves at least partially, and may dissolve completely. The material may dissolve via one or more mechanisms, such as oxidation, reduction, deterioration, go into solution, or otherwise lose sufficient mass and structural integrity.

The term "breakable material" as used herein may refer to a composition of matter having properties and/or characteristics that, while subject to change over time and/or under certain conditions, lead to brittleness. As one example, the material may be hard, rigid, and strong at ambient or surface conditions, but over time and under certain conditions, becomes brittle. The breakable material may experience breakage into multiple pieces, but not necessarily dissolution.

For some embodiments, a material of construction may include a composition of matter designed or otherwise having the inherent characteristic to react or change integrity or other physical attribute when exposed to certain wellbore conditions, such as a change in time, temperature, water, heat, pressure, solution, combinations thereof, etc. Heat may be present due to the temperature increase attributed to the natural temperature gradient of the earth, and water may already be present in existing wellbore fluids. The change in integrity may occur in a predetermined time period, which may vary from several minutes to several weeks. In aspects, the time period may be about 12 to about 36 hours.

The term "machined" can refer to a computer numerical control (CNC) process whereby a robot or machinist runs computer-operated equipment to create machine parts, tools and the like.

The term "plane" or "planar" as used herein may refer to any surface or shape that is flat, at least in cross-section. For example, a frusto-conical surface may appear to be planar in 2D cross-section. It should be understood that plane or planar need not refer to exact mathematical precision, but instead be contemplated as visual appearance to the naked eye. A plane or planar may be illustrated in 2D by way of a line.

The term "axial" as used herein may refer to orientation of a feature with respect to an axis. For example, a port may be 'axial', meaning the port has a centerline parallel to a reference axis, such as a longitudinal tool axis, within a high degree of precision and tolerance (e.g., 0.1 degrees).

The term "parallel" as used herein may refer to any surface or shape that may have a reference plane lying in the same direction or vector as that of another. It should be understood that parallel need not refer to exact mathematical precision, but instead be contemplated as visual appearance to the naked eye.

The term "run-in configuration" (run-in position, etc.) may refer to an arrangement of components on or coupled with a workstring collectively deployed downhole (such as into a wellbore or tubestring). 'Run-in' configuration is understood by one of skill in the art to precede in temporal sequence a set or disconnected configuration. The components of the workstring (separately or in combination) may be field dressed, shop dressed, and sometimes both. The 'run-in' configuration is akin to an 'unset' configuration.

The term "stroke" (or stroked, stroking, etc.) or "stroke configuration" as used herein may refer to a (temporal) moment in time where a tool or assembly is moving or being moved from a run-in configuration to a set configuration. 'Stroke' may include a range of movement, such as from beginning stroke, partial stroke, to fully stroke. The stroke may refer to movement of a part, such as a piston or mandrel.

The term "workstring" as used herein may refer to any type of device (e.g., wireline, etc.) that is operable to provide some kind of action, such as drilling, running a tool, or any other kind of downhole/wellbore action, and combinations thereof.

The term "sub" or "portion" may be used in an analogous manner to refer to a subassembly or component, which may be useable with another subassembly or component. One or more subs may be coupled together as an overall assembly and/or with a workstring.

Referring now to FIGS. 2A, 2B, 2C, 2D, and 2E together, a longitudinal side view of a downhole system having a completion assembly in a run-in configuration, a longitudinal side view of a downhole system having the completion assembly moved to a set, connected configuration, a longitudinal side view of a downhole system having the completion assembly moved to a set, disconnected configuration, a longitudinal side view of a downhole system having a completion assembly in a run-in configuration with an isolated pressure chamber, a longitudinal side view of a downhole system having the completion in a set configuration with integrity of an isolated pressure chamber maintained, a longitudinal side view a downhole system having a second isolated pressure chamber maintained, respectively, illustrative of embodiments disclosed herein, are shown.

FIGS. 2A-2F depict in simplified schematic or block form, and in a general nature. The simplistic nature of these figures is meant to be general without need of significant detail. One of skill would understand and appreciate that any number of components or downhole tools for use in a wellbore 206 may be run therein via a workstring 212. Detail and working knowledge of, for example, two modules or subassemblies coupled with each other, including in fluid communication, whereby one conveys fluid pressure to the other may be readily understood by one of skill in the art. Still, further understanding is readily available by reviewing other embodiments and disclosure provided.

As shown here, the wellbore 206 formed in a subterranean formation 210 with a tubular 208 disposed therein. The tubular 208 may be casing (e.g., casing, hung casing, casing string, etc.) (which may be cemented), and the like. The tubular 208 may be segmented or jointed, and thus joined by collars or any other type of tubular sub.

The workstring 212 may include a downhole completion assembly (or 'combination assembly', 'completion assembly', etc.) 201 coupled therewith. As shown here in the simplified form, the assembly 201 may include a first sub or portion 205, and a second sub or portion 220. The assembly 201 may have a run-in configuration where the first sub 205 may be engaged with the second sub 220. In aspects, the first sub 205 may be a retrievable sub, which may be retrieved (to the surface) or pulled out of the wellbore 206 once the second sub 220 is disconnected therefrom. The second sub 220 may be any type of downhole tool, such as a frac plug.

Figures 2A, 2B, 2C:
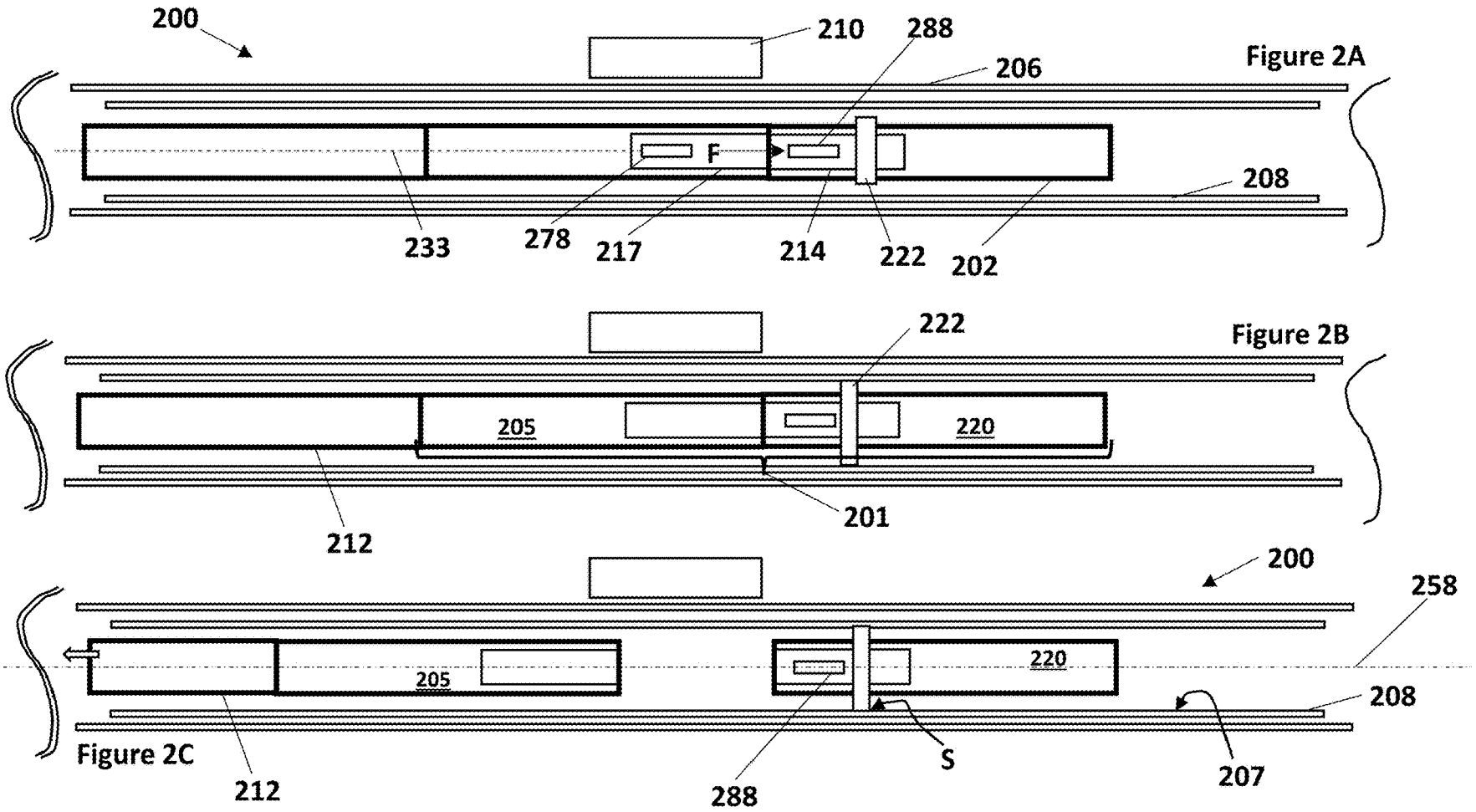
FIG. 2A shows a longitudinal side view of a downhole system represented in simplified block form having a completion assembly in a run-in configuration according to embodiments of the disclosure.
FIG. 2B shows a longitudinal side view of a downhole system represented in simplified block form having the completion assembly moved to a set, connected configuration according to embodiments of the disclosure.
FIG. 2C shows a longitudinal side view of a downhole system represented in simplified block form having the completion assembly moved to a set, disconnected configuration according to embodiments of the disclosure.

The completion assembly 201 may have another configuration, such as a disconnected configuration whereby the first sub 205 is disconnected from the second sub 220. FIG. 2A shows the run-in configuration of the combination assembly 201 (or system 200), with the first sub 205 coupled or engaged with the second sub 220. For comparison FIG. 2C shows the combination in the disconnected configuration, with the first sub 205 disengaged (disconnected, etc.) from the second sub 220.

The first sub 205 may be or include a power charge mandrel 217 or other suitable (elongated) tubular type component. The power charge mandrel 217 may be coupled with the second sub 220, such as to a (tool) mandrel 214. Thus, in the run-in configuration, the power charge mandrel 217 may be engaged with the downhole tool (or a component thereof) 202.

The power charge mandrel 217 may include a tension or power charge mandrel end. Although not shown here, the power charge mandrel 217 (or its end) may extend, at least partially, through or out of the (bottom/downhole/distal end) tool 202.

The downhole tool 202, as well as its components, may be annular in nature, and thus centrally disposed or arranged with respect to a longitudinal axis 258. As mentioned, the assembly 201 may have a first or run-in configuration. FIGS. 2A, 2B, and 2C generally show a non-limiting representation of a temporal operational sequence whereby the completion assembly undergoes a change in configuration (s).

As one of skill in the art would appreciate, the completion assembly 201 may have the run-in configuration, as well as a second, set, connected (also, intermediate or stroke) configuration of FIG. 2B. The set configuration may include a transition aspect for the completion assembly 201. The set configuration may include a range of position, such as from a beginning to set, to partial set, to fully set. As the completion assembly 201 moves from the run-in configuration to a (third) set, disconnected configuration, some amount of time will pass where the completion assembly undergoes stroke. In aspects, the fully set configuration may be (nearly) instantaneous to the set, disconnected configuration.

FIG. 2B shows the assembly 201 in the set, connected configuration (depending on operation, any range of set configuration may include the first sub engaged with the second sub, or may include the first sub disengaged from the second sub). FIGS. 2A and 2B together illustrate the sequence in a moment in time of the assembly 201 may be stroked in order to move from the run-in configuration to the eventual set, disconnected configuration of FIG. 2C. There may be a set, but still-connected configuration. For example, the second sub 220 may be fully stroked at around 50-70% of the setting force, and then loading up the shear feature until it shears.

In accordance with the disclosure, the first sub 205 may be activated via a signal 233. The signal 233 may be, for example, via electric transmission from a surface facility (operator workstation, etc.) through the workstring 212 down tool the power charge mandrel 217, and need not be illustrated here as one of skill in the art is well versed in providing activation signals downhole.

Upon activation, a trigger mechanism such as a firing head (not shown here) may activate in such a manner that a power charge 278 (or other suitable material) is ignited and begins to burn. The combustion gases increase fluid pressure F within the power charge mandrel 217, which may be transferred or conveyed (such as via ports or the like, not shown here) from the first sub 205 to the second sub 220. The second sub 220 may have a working surface (movable member, piston, etc.) 288 for which the fluid F may act (such as directly) thereagainst, resulting in a hydraulic, non-mechanical force to the downhole tool 202.

The power charge mandrel 217 may have an inner charge bore (not shown here) for which the power charge 278 may be disposed therein. The firing head may have a corresponding firing head bore that may provide a flame path for a respective flame or other igniting source to communicate ultimately to the charge 278.

As the power charge 278 need not be rigid or solid (and thus may be soft or putty- or paste-like), the power charge 278 may assume any general non-limiting shape, such as cylindrical, rectangular prism, helical (coiled), cylindrical-helical, and the like.

The amount of power charge may be of sufficient amount of material to provide enough gas via reaction to provide at least 8,500 psi pressure F. However, the amount of pressure is not meant to be limited, and as such the amount of pressure upon burning of the power charge 278 may be any amount as needed subject to downhole tool needs or other conditions. As an example, the amount of pressure F may be in a range of about 500 psi to about 75,000 psi. Actuation of the power charge 278 may be from or via the signal 233 from the surface (e.g., surface facility, an operator, etc.). In aspects, the signal 233 may instigate igniters to fire an initiator pellet, which may then start the propellant reaction of the power charge 278 (or other suitable firing mechanism).

Pressure may be generated (created, increased, etc.) by the reaction as a result of forming (more) gas. The gas (pressure) may be fluidly communicated from the first sub 205 to the second sub 220. As the fluid pressure F increases, expands, and moves into the second sub 220, it may act on a pressure chamber (area or volume) (e.g., 237 FIG. 2E), or working surface 288. The pressure F may act directly on or against the surface 288.

Generally, the pressure chamber may be understood as a dynamic aspect of the completion assembly 201. That is, one of skill would appreciate the pressure chamber may be or have a (infinitesimally) small amount of space between proximate components (such as in the run-in configuration), but grow or change to a larger amount of space as fluid pressure causes motion M.

The fluid pressure F may increase to a first preliminary or pre-determined amount that results in sufficient force to move the assembly 201 from the run-in configuration shown in FIG. 2A to the set configuration shown in FIG. 2B. This first pre-determined force may be based on the amount of fluid pressure F acting on the working surface 288 (for a non-limiting example, this may be in the range of about 3,000 to about 20,000 lbs force).

The resultant pressure/force may consequently result in movement (or urge) of one or more housings, sleeves, slips, etc. of the downhole tool 202. As such, the combination assembly 201 (or the tool 202) may be movable from the first configuration (2A) to the next configuration (2B). In the first or next configuration the first sub 205 may remain, at least partially, engaged with the second sub 220.

Once the second sub 220 (or tool 202) is set (e.g., in the set configuration), the connection between the first sub 205 and the second sub 220 may be broken. For example, mating threads may be designed to shear, and thus may be pulled and sheared accordingly in a manner known in the art. The non-limiting amount of load applied for disconnect may be in the range of about, for example, 1,000 pounds force to 100,000 pounds force. The amount of load is not meant to be limited, as the combination assembly 201 of the disclosure may include varied setting and downhole tools suitable to different environments.

It would be apparent that the set force requirement may be equal to the disconnect force requirement, such that in some aspects the set configuration and the disconnected configuration may be the same. It would also be apparent that the amount of force may vary depending on the surface are of the working surface 288. For example, the working surface 288 may have a non-limited surface area in a range of about 1 inch squared to about 175 inches squared.

FIG. 2C shows the next configuration, which may be the disconnected configuration. In this configuration, the working surface 288 (of second sub 220) of which hydraulic/gas pressure (or non-mechanical force) may act against, may be seen as remaining downhole in the wellbore 206. In conventional setting and disconnect, working surfaces disconnect and are removed out of hole, which attributes to the known detriments of conventional setting tools.

In the disconnected configuration, the workstring 212 (and first sub 205) is able to separate from the second sub 220 (and downhole tool 202). The loads provided herein are non-limiting and are merely exemplary. As shown here, in this configuration the second sub 220 may be completely disconnected (disengaged, decoupled, etc.) from the first sub 205. Analogously, the downhole tool 202 may be completely disconnected from the power charge mandrel 217.

In the operation of the system 200 it may be desired to retrieve or remove the first sub 205 from the wellbore 206 so that one or more downhole operations may commence, such as hydraulic fracturing. Although one or more components of the second sub 220 may be left in the wellbore 206 in the disconnected configuration, one of skill would appreciate, this need not be indefinitely, and thus only for a period of time. For example, one or more components of the second sub 220 may eventually dissolve or be destroyed (via drilling or the like), as may be desired.

In accordance with embodiments of the disclosure, the tool 202 may be configured as a plugging tool, which may be set within the tubular 208 in such a manner that the tool 202 forms an engagement (for example, a fluid-tight seal) S against the inner surface 207 of the tubular 208. The seal S may be facilitated by a component(s) (such as a seal element) 222 urged, moved, expanded, etc. into a gripping, sealing position against the inner surface 207. Engagement of the tool 202 need not be permanent or anchored.

Although shown in simplified form here, the component 222 may be one or more components of the downhole tool 202 in operable communication with the working surface 288. In this respect, as the working surface 288 moves, the movement of the working surface 288 imparts movement to the component 222.

The downhole tool 202 may include the mandrel 214 configured to extend, at least partially, through the tool 202 (or tool body). The mandrel 214 may be a solid body. In other aspects, the mandrel 214 may include a flowpath or bore formed therein (e.g., an axial bore).

Operation of the downhole tool 202 may allow for fast run in of the tool 202 to isolate one or more sections of the wellbore 206, as well as quick and simple drill-through or dissolution to destroy or remove the tool 202.

Accordingly, in some embodiments, drill-through may be completely unnecessary. As such the downhole tool 202 may have one or more components made of a reactive material, such as a metal or metal alloys. The downhole tool 202 may have one or more components made of a reactive material (e.g., dissolvable, degradable, etc.), which may be composite- or metal-based.

Figure 2D:
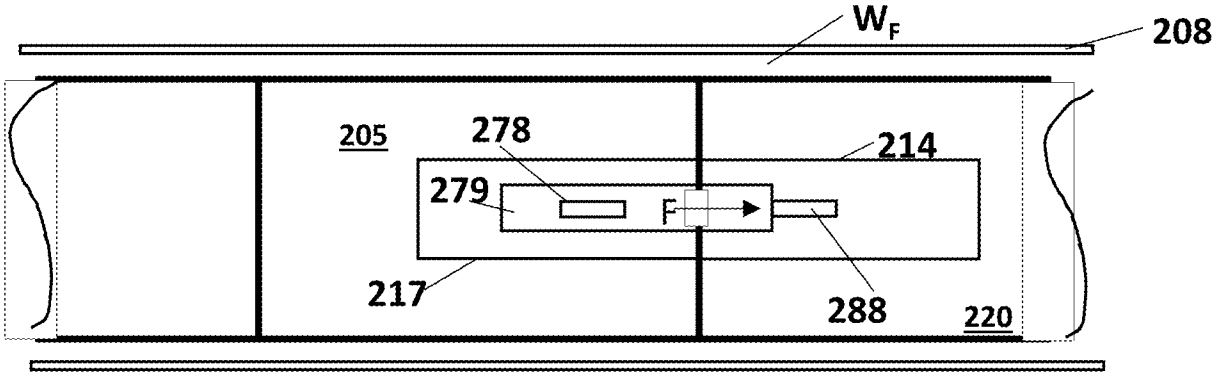
FIG. 2D shows a longitudinal side view of a downhole system represented in simplified block form having a completion assembly in a run-in configuration with an isolated pressure chamber according to embodiments of the disclosure.
Figure 2E:
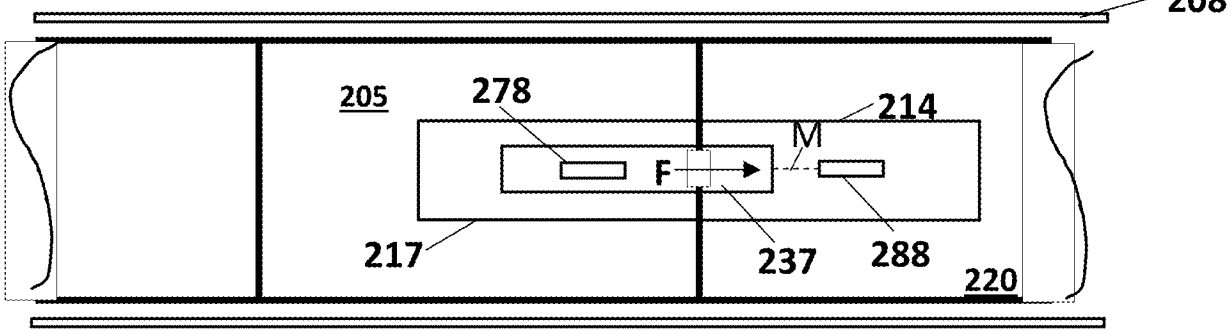
FIG. 2E shows a longitudinal side view of a downhole system represented in simplified block form having the completion assembly of FIG. 2D in a set configuration with integrity of the isolated pressure chamber maintained according to embodiments of the disclosure.
Figure 2F:
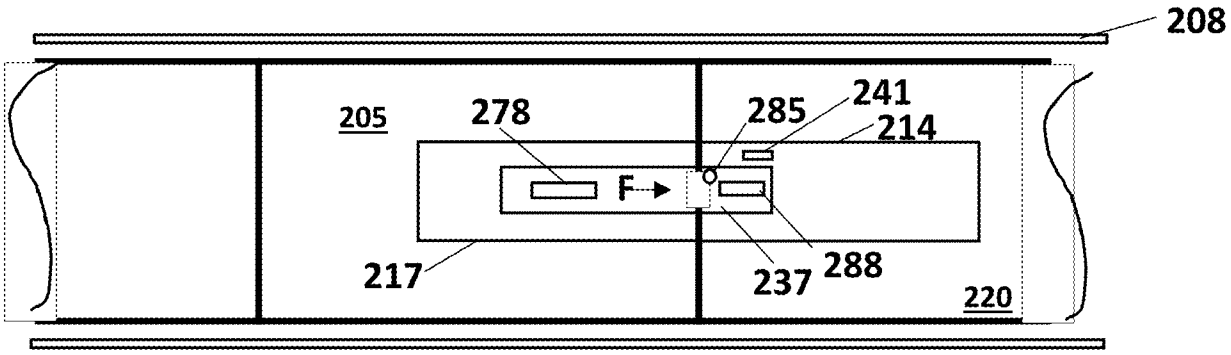
FIG. 2F shows a longitudinal side view of a downhole system represented in simplified block form having a second isolated pressure chamber maintained according to embodiments of the disclosure.

FIGS. 2D and 2E together show an up close, simplified box view of an embodiment of the completion assembly 201 whereby the first sub 205 and the second sub 220 may be coupled together during the run-in configuration, and also when the completion assembly is moved from the run-in configuration to the set configuration.

As shown, the first sub may have an inner charge bore (or also pressure chamber) 279. The second sub 220 may have a respective chamber 237, which may be in fluid communication with chamber 279. When the charge 278 ignites, the increase in pressure may result in direct transfer of the pressure (or force) F from the first sub 205 to the second sub 220, such that it acts against working surface 288.

In this respect, the second sub 220 may be configured and used to facilitate keeping the chamber 279 (or inner first sub 205) isolated from any surrounding wellbore fluid $W_F$ (such as any fluid(s) that may be present in the tubular 208). The second sub 220 may also be configured and used to facilitate keeping the respective chamber 237 isolated from any surrounding wellbore fluid $W_F$. Even as the completion assembly moves from the run-in configuration of FIG. 2D to the set configuration of FIG. 2E, isolation and integrity of the chamber 279 may be maintained. Isolation of the chambers 237, 279 from any wellbore fluid $W_F$ may cease once the assembly 201 moves to the disconnected configuration.

Although FIGS. 2D and 2E show the working surface 288 being as part of or disposed in the mandrel 214, embodiments herein are not meant to be limited. For example, the working surface 288 may be associated with another component of the second sub, and may also be external of the mandrel (such as being associated with a load bearing ring disposed around the mandrel).

What may also be noticed about FIGS. 2D and 2E is the complete lack of any moving parts associated with the first sub 205. Instead, (non-mechanical) force F may be used directly against the working surface 288, resulting in some kind of movement or motion M attributable to the completion assembly 201 moved to the set configuration. One of skill would appreciate further increase in pressure through continued burning of charge 278 would eventually result in the first sub 205 disconnected from the second sub 220 (e.g., disconnected configuration [FIG. 2C]).

As may also be noticed, the first sub 205 is completely void of any kind of barrel piston, setting tool adapter (or adapter kit), and/or setting sleeve. As such, in the disconnected configuration any excess gas from the assembly 201 may be vented into the tubular 208.

Figure 3A:
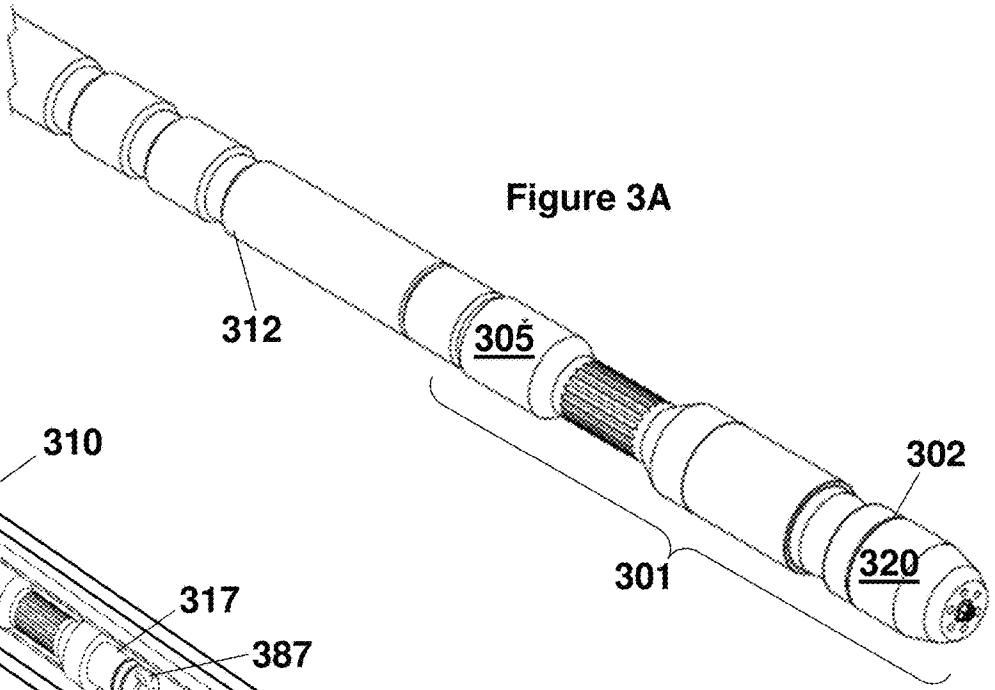
FIG. 3A shows an isometric view of a completion assembly useable in a wellbore according to embodiments of the disclosure.
Figure 3B:
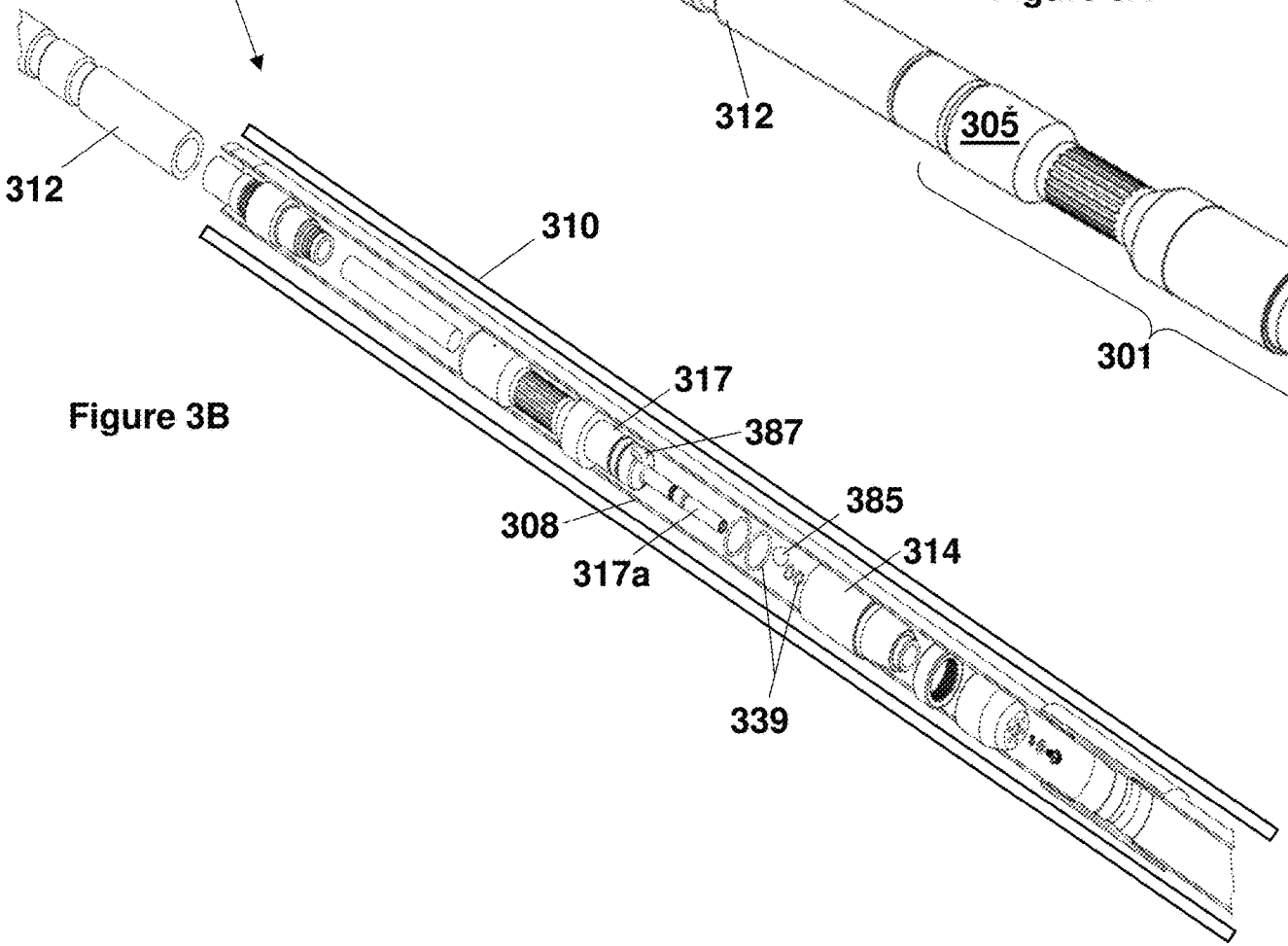
FIG. 3B shows an isometric component breakout view of a downhole setting system having a completion assembly with a power charge mandrel and a downhole tool according to embodiments of the disclosure.
Figures 3C, 3D, 3E:
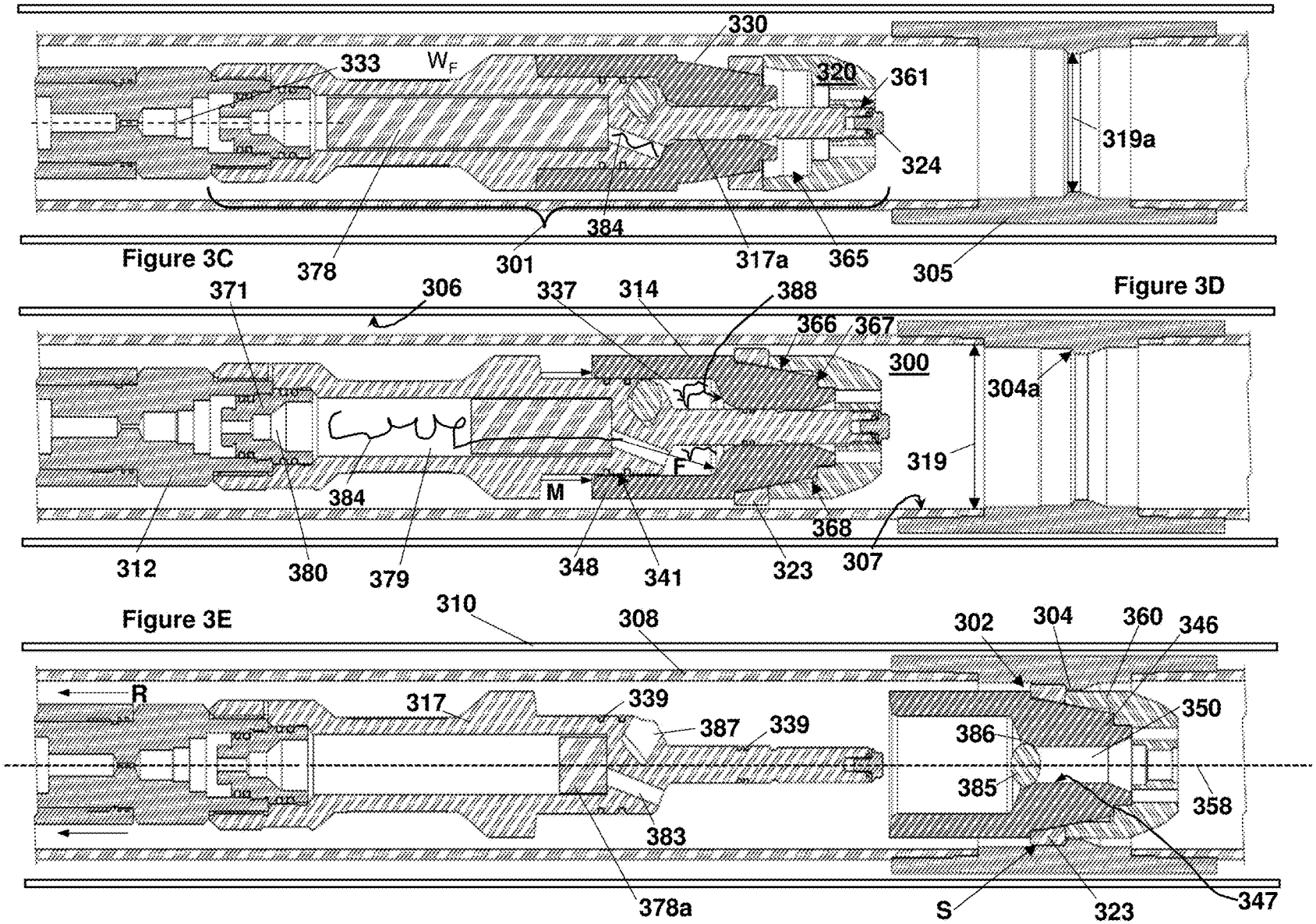
FIG. 3C shows a longitudinal side cross-sectional view of a completion assembly in a run-in configuration according to embodiments of the disclosure.
FIG. 3D shows a longitudinal side cross-sectional view of the completion assembly of FIG. 3C moved from the run-in configuration toward a set configuration according to embodiments of the disclosure.
FIG. 3E shows a longitudinal side cross-sectional view of the completion assembly of FIG. 3C moved to a disconnected configuration according to embodiments of the disclosure.

Referring now to FIGS. 3A, 3B, 3C, 3D, and 3E together, an isometric view of a completion assembly useable in a wellbore, an isometric component breakout view of a downhole setting system having a completion assembly with a power charge mandrel and a downhole tool, a longitudinal side cross-sectional view of a completion assembly in a run-in configuration, a longitudinal side cross-sectional view of the completion assembly of FIG. 3C moved from the run-in configuration toward a set configuration, and a longitudinal side cross-sectional view of the completion assembly of FIG. 3C moved to a disconnected configuration, respectfully, in accordance with embodiments disclosed herein, are shown.

Completion assembly 301 may be run, set, and operated as described herein and in other embodiments (such as in System 200, etc., and so forth), and as otherwise understood to one of skill in the art. Components of the completion assembly 301 may be arranged and disposed as described herein and in other embodiments, and as otherwise understood to one of skill in the art. Thus, the completion assembly 301 may be comparable or identical in aspects, function, operation, components, etc. as that of other embodiments disclosed herein. Similarities may not be discussed for the sake of brevity.

Operation of the completion assembly 301 may allow for fast run in of a downhole tool 302, which may be useable to isolate one or more sections of a wellbore 306 as provided for herein. In some embodiments, the downhole tool 302 may be free floating and/or non-anchored. The system 300 may include the wellbore 306 formed in a subterranean formation 310 with a tubular 308 disposed therein. A workstring 312 may include a downhole completion assembly (or 'combination assembly', 'completion assembly', etc.) 301 coupled therewith. The assembly 301 may include a first sub or portion 305, and a second sub or portion 320. In aspects, the first sub 305 may be a retrievable sub, which may be pulled out of the wellbore 306 once the second sub 320 is disconnected therefrom. The second sub 320 need not be retrieved out of the wellbore 306, and thus any part or component of the sub (or entirety thereof) may remain in the wellbore 306 for any desired period of time.

In this respect, the completion assembly 301 may have another configuration, such as a disconnected configuration whereby the first sub 305 is disconnected from the second sub 320. The run-in configuration of the combination assembly 301 (or system 300) may include the first sub 305 coupled or engaged with the second sub 320. In contrast, the disconnected configuration may include the first sub 305 disengaged from the second sub (or at least portions thereof).

The first sub 305 may be or include a power charge mandrel 317. The power charge mandrel 317 may be coupled with the second sub 320, such as to a (tool) mandrel 314. Thus, in the run-in configuration, the power charge mandrel 317 may be engaged with the downhole tool (or a component thereof) 302.

The power charge mandrel 317 may include a tension or power charge mandrel end 317*a*. In aspects, the power charge mandrel 317 (or its end 317*a*) may extend, at least partially, through or out of the (bottom/downhole/distal end) tool 202.

The downhole tool 302, as well as its components, may be annular in nature, and thus centrally disposed or arranged with respect to a longitudinal axis 358. FIGS. 3C, 3D, and 3E generally show a non-limiting representation of a temporal operational sequence whereby the completion assembly undergoes a change in configuration(s).

As one of skill in the art would appreciate, the completion assembly 301 may have the run-in configuration, as well as a second, set, connected (also, intermediate or stroke) configuration of FIG. 3D. The set configuration may include a transition aspect for the completion assembly 301. The set configuration may include a range of position, such as from a beginning to set, to partial set, to fully set. As the completion assembly 301 moves from the run-in configuration to a (third) set, disconnected configuration, some amount of time will pass where the completion assembly undergoes stroke. In aspects, the fully set configuration may be (nearly) instantaneous to the set, disconnected configuration.

The assembly 301 in the set, connected configuration (depending on operation), any range of set configuration may include the first sub 305 engaged with the second sub 320, or may include the first sub 305 disengaged from the second sub 320. The assembly 301 may be stroked to move from the run-in configuration to the eventual set, disconnected configuration of FIG. 3E. There may be a set, but still-connected configuration. For example, the second sub 320 may be fully stroked at around 50-70% of the setting force, and then loading up the shear feature until it shears.

The amount of power charge 378 may be of sufficient amount of material to provide enough gas via reaction to provide at least 8,500 psi pressure F. However, the amount of pressure is not meant to be limited, and as such the amount of pressure upon burning of the power charge 378 may be any amount as needed subject to downhole tool needs. As an example, the amount of pressure F may be in a range of about 500 psi to about 75,000 psi. Actuation of the power charge 378 may be from or via the signal 333 from the surface (e.g., surface facility, an operator, etc.). For example, the signal 333 instigate igniters to fire an initiator pellet, which may then start the propellant reaction of the power charge 378 (or other suitable firing mechanism).

Ultimately the fluid pressure F may increase to a first preliminary or pre-determined amount that results in sufficient force to move or urge the assembly 320 from the run-in configuration shown in FIG. 3C to the set configuration shown in FIG. 3D/3E. This first pre-determined force may be based on the amount of fluid pressure F acting on the working surface 388 (for a non-limiting example, this may be in the range of about 3,000 to about 20,000 lbs force).

Once the second sub 320 (or tool 302) is set (e.g., in the set configuration), the connection between the first sub 305 and the second sub 320 may be broken. For example, mating threads may be designed to shear, and thus may be pulled and sheared accordingly in a manner known in the art. The non-limiting amount of load applied for disconnect may be in the range of about, for example, 1,000 pounds force to 100,000 pounds force. It would also be apparent that the amount of force may vary depending on the surface are of the working surface 388. For example, the working surface 388 may have a non-limited surface area in a range of about 1 inch squared to about 175 inches squared.

FIG. 3E shows the next configuration, which may be the disconnected configuration. In this configuration, the working surface 388 (of second sub 320) of which hydraulic/gas pressure (force) may act against, may be seen as remaining downhole in the wellbore 306. In conventional setting and disconnect, working surfaces disconnect and are removed out of hole, which attributes to the known detriments of conventional setting tools.

In the disconnected configuration, the workstring 312 (and first sub 305) is able to separate from the second sub 320 (and downhole tool 320). In aspects, it may be that at least one component of the first sub 305 may be disconnected from at least one component of the second sub 320. The loads provided herein are non-limiting and are merely exemplary. As shown here, in this configuration the second sub 320 may be completely disconnected (disengaged, decoupled, etc.) from the first sub 305. Analogously, the downhole tool 302 may be completely disconnected from the power charge mandrel 317.

The second sub 320 may be configured and used to facilitate keeping chambers 337 and/or 379 isolated from any surrounding wellbore fluid $W_F$ (such as any fluid(s) that may be present in the tubular 308). Even as the completion assembly moves from the run-in configuration of FIG. 3C to the set configuration of FIG. 3D, isolation and integrity of the chamber 337, 379 may be maintained. One of skill would appreciate the chambers (and thus the respective subs) 337, 379 may be in fluid communication (such as in the run-in configuration).

What may also be noticed about FIGS. 3D and 3E is the complete lack of any moving parts associated with the first sub 305. Instead, (non-mechanical) pressure/force F may be used directly against the working surface 388, resulting in some kind of movement or motion M attributable to the completion assembly 301 moved to the set configuration. One of skill would appreciate further increase in pressure through continued burning of charge 378 would eventually result in the first sub 305 disconnected from the second sub 320 (e.g., disconnected configuration [FIG. 3E]).

As may also be noticed, the first sub 305 is completely void of any kind of barrel piston, setting tool adapter (or adapter kit), and/or setting sleeve. As such, in the disconnected confirmation any excess gas from the assembly 301 may be vented into the tubular 308.

Operation of the downhole tool 302 may allow for fast run in of the tool 302 to isolate one or more sections of a wellbore 306 as provided for herein. The mandrel 314 (cone, cone mandrel, etc.) may be a solid body. In other aspects, the mandrel 314 may include a flowpath or bore 350 formed therein (e.g., an axial bore). The bore 350 may extend partially or for a short distance through the mandrel 314. Alternatively, the bore 350 may extend through the entire mandrel 314, with an opening at its proximate end 348 and oppositely at its distal end 346.

With the presence of the bore 350, the mandrel 314 may have an inner bore surface 347, which may include one or more threaded surfaces formed thereon. As such, there may be a first set of threads configured for coupling the mandrel 314 with corresponding threads of a power charge mandrel 317. The coupling may be via other comparable mechanism (s), such as shear pin or the like (see coupling or shear feature 361)

The downhole tool 302 may be run into wellbore 306 (such as within tubular 308) to a desired depth or position by way of the workstring 312 that may be configured with the setting (stroke) device or mechanism in the form of the power charge mandrel 317, and thus part of an overall system 300.

A lower sleeve 360 may be configured with a shear point, such as a shear tab or shear threads. The shear feature 361 may be engaged with the power charge mandrel 317. As shown, the shear feature 361 may be engaged or proximate to each of the power charge mandrel end 317*a* and/or a nose nut 324. The lower sleeve 360 (or the shear feature) may be configured to facilitate or promote deforming, and ultimately shearing/breaking, during setting.

The shear feature 361 may be configured to shear at a load greater than the load for setting the tool 302. Once sheared, the lower sleeve 360 may fall away from the tool 302; however, in an expanded (or disconnected) state, the tool 302 may not fall any further than respective profile 304 (which may be part of a profile sub 305 and/or the tubular 308). However, the lower sleeve 360 may be configured for an interference fit with the mandrel 314, such that these components remain engaged with each other, as depicted in FIG. 3E.

The set or activated configuration of the tool 302 may include components of the tool 302 compressed together, but the tool 302 need not set or be engaged against the tubular 308 (which may be defined by a tubular inner diameter 319 of an inner tubular surface 307). Instead, the tool 302 may free float (i.e., move freely) unless and until it may be urged into engagement with a shoulder 304*a* of profile 304 (see 3E). The profile may be negative or positive, and thus have an inner profile diameter 319*a* larger or smaller than the tubular inner diameter 319, respectively. The tubular 308 may be run in the wellbore 306 with one or more profiles disposed therewith and/or with a coupled profile sub. Just the same, one or more profiles (or profile subs) may be integral to the tubular 308.

The power charge mandrel 317 may have the inner charge chamber or bore 379 for which the power charge (or other comparable pyro-material) 378 may be disposed therein. A firing head 371 may have a corresponding firing head bore 380 suitable to provide a flame path for a respective flame or other igniting source to communicate to the inner charge bore 379 (and ultimately to the charge 378).

The firing head 371 and other portions of the workstring 312 may be only shown in brevity. One of skill would appreciate conventional components usable for operation of the firing head and igniting of the power charge 378 may be used, even if not show or described here. The power charge 378 may be like that of other power charge(s) described herein (e.g., 278). The power charge 378 may be of a sufficient amount to have burn time to create sufficient pressure within primary pressure chamber 337 for setting and disconnect of the tool 302.

Fluid pressure F may be generated within the inner charge bore 379 by the reaction as a result of forming gas 484. The gas 384 formed initially within the bore 379 may be fluidly communicated to the pressure chamber 337 via one or more ports 383 (of the power charge mandrel 317). In embodiments, there may be about 1 to about 15 ports 383. The ports 383 may be spaced symmetrically, asymmetrically, or combinations of both, with respect to each other. The ports 383 may be axial, radial, multi-direction, or as otherwise needed. Although not shown here, the ports 383 may have a longitudinal bore axis in parallel to a longitudinal tool axis 358.

As the gas 384 increases, expands, and moves into the primary chamber 337, it may act on a sleeve piston area, or working surface, 388. The (annular) surface 388 may be the (approximate) working surface to which the pressure (and thus force) is applied.

The first sub 305 may thus be used to facilitate a push in the direction of movement arrow M (via gas 384) (or alternatively, the mandrel 314 urged in the opposite direction), one or more the components may begin to compress or urge against one another. This force and resultant movement may urge an expansion sleeve or ring 323 to compressively slide against outer surface 330 of the mandrel 314, and ultimately expand. Thus, the expansion ring 323 may be movingly (e.g., slidingly) engaged with the mandrel 317.

As the lower sleeve 360 experiences setting forces (e.g., pull), the lower sleeve 360 (being engaged with the expansion sleeve 323) may urge the 323 to compressively slide against the outer surface 330. As expansion occurs, the sleeve 323 may move radially outward, but will not expand into engagement with the surrounding tubular 308; at least not the degree that the tool 302 may not move.

Ultimately the pressure within the chamber 337 may increase to a first preliminary or pre-determined (or also first actuation) force that moves components along the mandrel 314 (e.g., transition from view of FIG. 3C to 3D). Continuing of the increase in pressure within the chamber 337 ultimately results in the tool 302 moved to the set configuration, and eventually a disconnected or third configuration (e.g., transitioning from view of FIG. 3D to 3E).

Figure 6B:
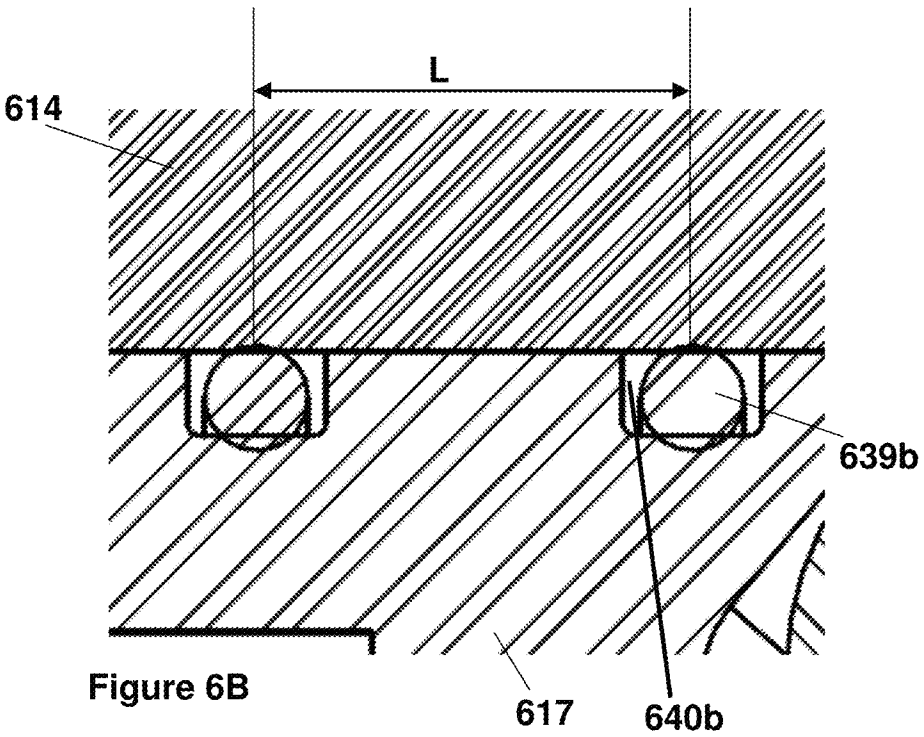
FIG. 6B shows a close-up longitudinal cross-sectional side view of the secondary pressure chamber acted on by one or more pressure sources according to embodiments of the disclosure.
Figure 6A:
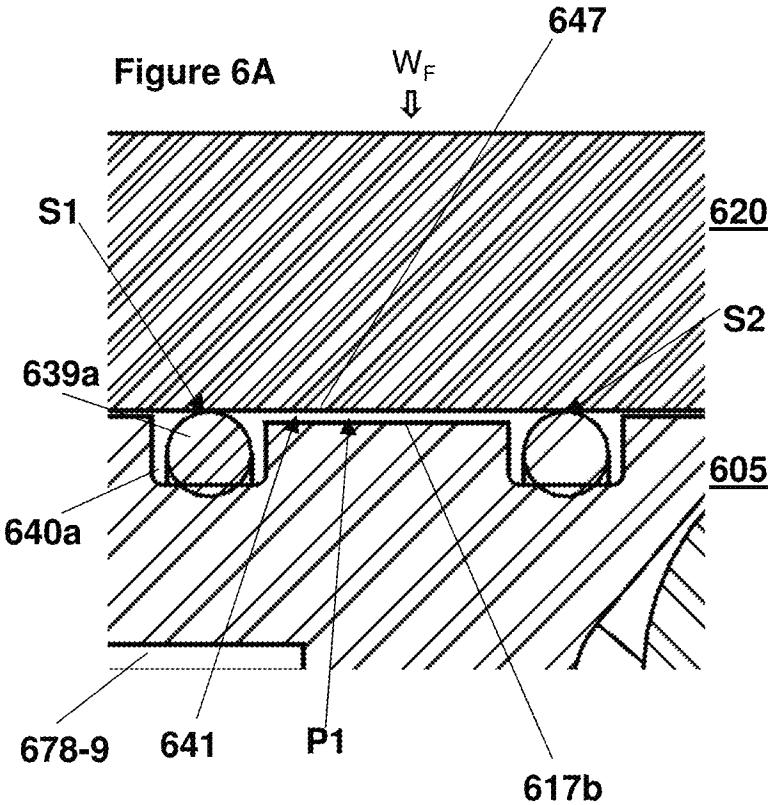
FIG. 6A shows a close-up longitudinal cross-sectional side view of a secondary pressure chamber according to embodiments of the disclosure.

Referring briefly to FIGS. 6A and 6B, a close-up longitudinal cross-sectional side view of a secondary pressure chamber, and a close-up longitudinal cross-sectional side view of the secondary pressure chamber acted on by one or more pressure sources, respectfully, in accordance with embodiments disclosed herein, are shown.

Any completion assembly of the present disclosure may utilize a primary pressure chamber (e.g., 241, 341, etc.), as well as a secondary pressure chamber 641. Although not limited to any particular configuration, there may be, for example, a first sub 605 in proximity to or engaged with a second sub 620. The first sub 605 may include one or more member receptacles 640*a*, 640*b* configured for respective seal members 639*a*, 639*b* to be disposed therein. Seal members 639*a*, 639*b* may be o-rings or the like.

In an assembled run-in configuration the second sub 620 may be coupled with the first sub 605 in a manner to be sealingly engaged. Forming the seal S1, S2 or pressure barrier between the respective seal members 639*a*, 639*b* (as well as between sidewalls 617*a*, 647) may result in the integrity of pressure P1 (e.g., 14.7 psi) in secondary chamber 641 maintained while the completion assembly runs downhole.

In the example shown the secondary pressure chamber 641 may be formed and maintained between respective components of the subs 605, 620, such as a power charge mandrel 617 and a (tool) mandrel 614. In the first or run-in configuration the pressure chamber 641 may have an approximate volume or space as seen between the seal members 639*a*, 639*b* (and a straight line length L therebetween), and the sidewall surface power charge mandrel, as well as the sidewall or bore surface 647 of the mandrel 614.

The volume of the chamber 641 need not be static, and instead may be dynamic or change, depending on operation or wellbore conditions. For example, surrounding wellbore fluid $W_F$ may exert pressure (shown via arrow) and/or inner fluid pressure (such as gas pressure formed or increased in power charge bore 679 may do the same. The conditions of the pressure(s) may result in minimizing or changing the chamber, as seen in FIG. 6B.

Conventional downhole tools may utilize o-rings, but only for the purpose of redundancy. The applicant has discovered there may be a need and use of the secondary chamber 641 to facilitate overall operation. While the pressure P1 may be atmospheric, downhole conditions may exert greater pressure against the chamber; however, as the assembly (e.g., 201, 301, etc.) moves from the run-in configuration to a set or disconnected configuration, the pressure from the bore 679 may become greater, and cause an outward ballooning that could cause undesired extrusion of members 639*a*, 639*b*. The importance of the chamber 641 may be the spacing that results from length L. In embodiments, the length L may be in a length range of about 0.2 inches to about 10 inches. In certain embodiments the length range may be about 0.2 inches to about 0.6 inches.

Returning now to FIGS. 3A-3E, it may be the case that the mandrel 314 may be configured with a plug seat 386 formed or removably disposed therein. In some embodiments, the plug seat 386 may be integrally formed within the bore 350 of the mandrel 314. The plug seat 386 may be used to seat any type of plug or isolation device, such as a ball or a flapper. In other embodiments, the seat 386 may be separately or optionally installed within the mandrel 314, as may be desired.

The plug seat 386 may be configured in a manner so that a ball or other form of plug/obstruction 385 may seat or rest therein, whereby the flowpath through the mandrel 314 may be closed off (e.g., flow through the bore 350 is restricted or controlled by the presence of the plug). In this respect, once the power charge mandrel 317 (and the workstring 312) is disconnected from the tool 302, the plug 385 may be free to seat thereagainst.

For example, fluid flow from one direction may urge and hold the plug 385 against the seat 386, whereas fluid flow from the opposite direction may urge the plug 385 off or away from the seat 386. As such, the plug 385 be used to prevent or otherwise control fluid flow through the tool 302.

The assembly 301 may have one or more side ports, which may be useful to further assist moving the plug 385 out of a plug run-in receptacle 387. That is, as gas 384 (from power charge 378) expands and flows through the ports, etc., the gas 384 may push or urge against the plug 385.

Put another way, once the tool 302 has been disconnected (from power charge mandrel 317), (high velocity) gas 384 may still be flowing through the ports, thus causing the plug 385 to eject or move from the receptacle 387 that the plug 385 was recessed or initially disposed into. The receptable 387 may be part of or in communication with chamber 337 in the run-in configuration, such that the plug 385 (and seat 386) may be isolated from any wellbore fluids.

In the run-in configuration there may be a first clearance 365 formed between the lower sleeve 360 and the power charge mandrel end 317*a* and/or mandrel 314. In the run-in configuration, the lower sleeve 360 may not be in any kind of direct engagement with the mandrel 314. FIG. 3D shows the first clearance 365 of non-engagement eliminated or reduced as a result of a first contact point 366 between the mandrel 314 and the lower sleeve 360 when the downhole tool 302 is moved to the set configuration. In the set configuration, there may be a second clearance 368 that is formed between first contact point 366 and a second contact point 367.

Figure 4A:
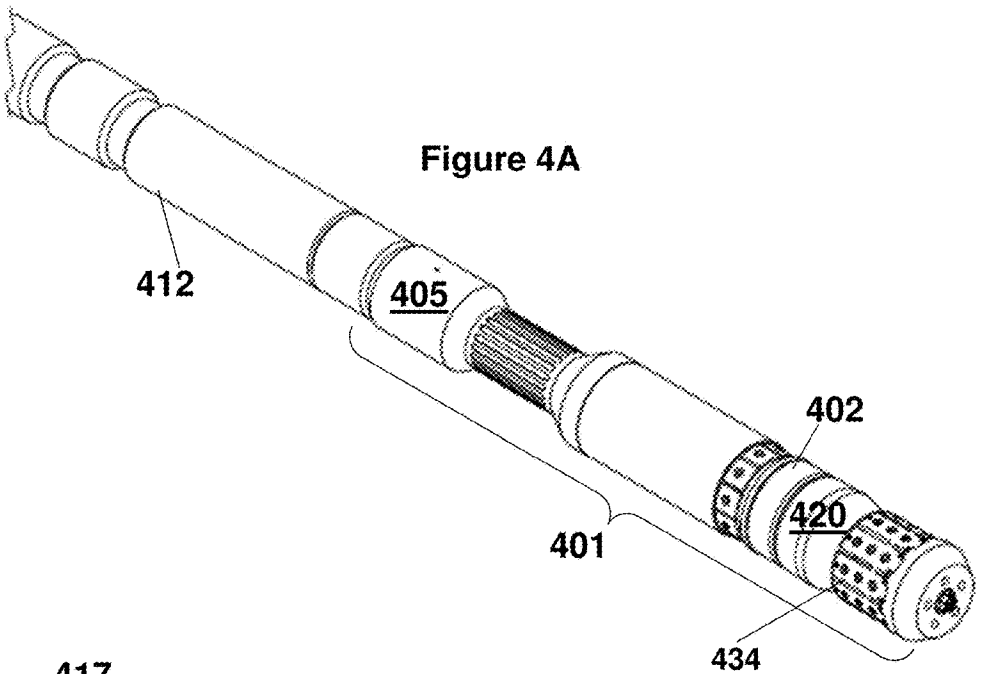
FIG. 4A shows an isometric view of a completion assembly useable in a wellbore according to embodiments of the disclosure.
Figure 4B:
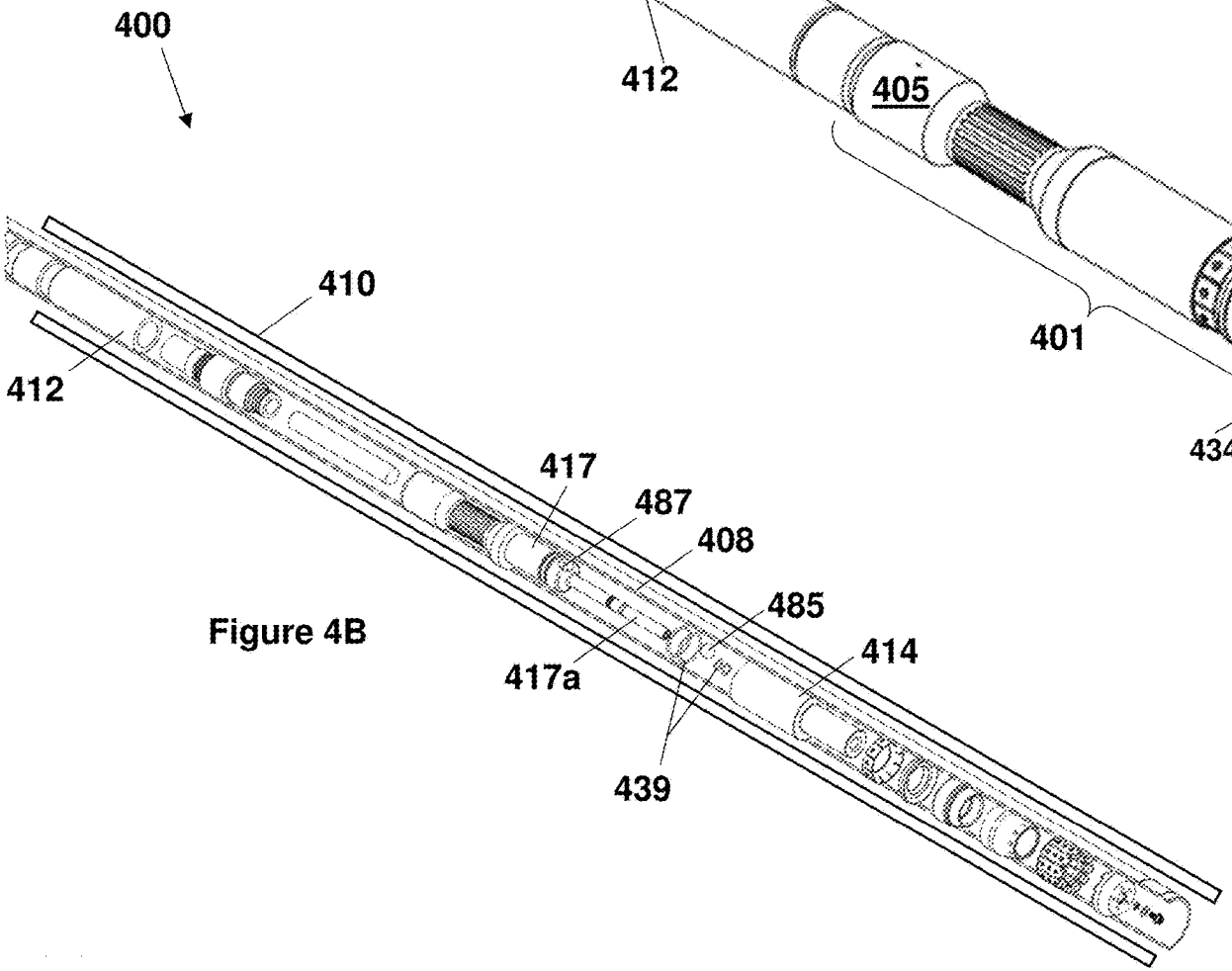
FIG. 4B shows an isometric component breakout view of a downhole setting system having a completion assembly with a power charge mandrel and a downhole tool according to embodiments of the disclosure.
Figure 4C:
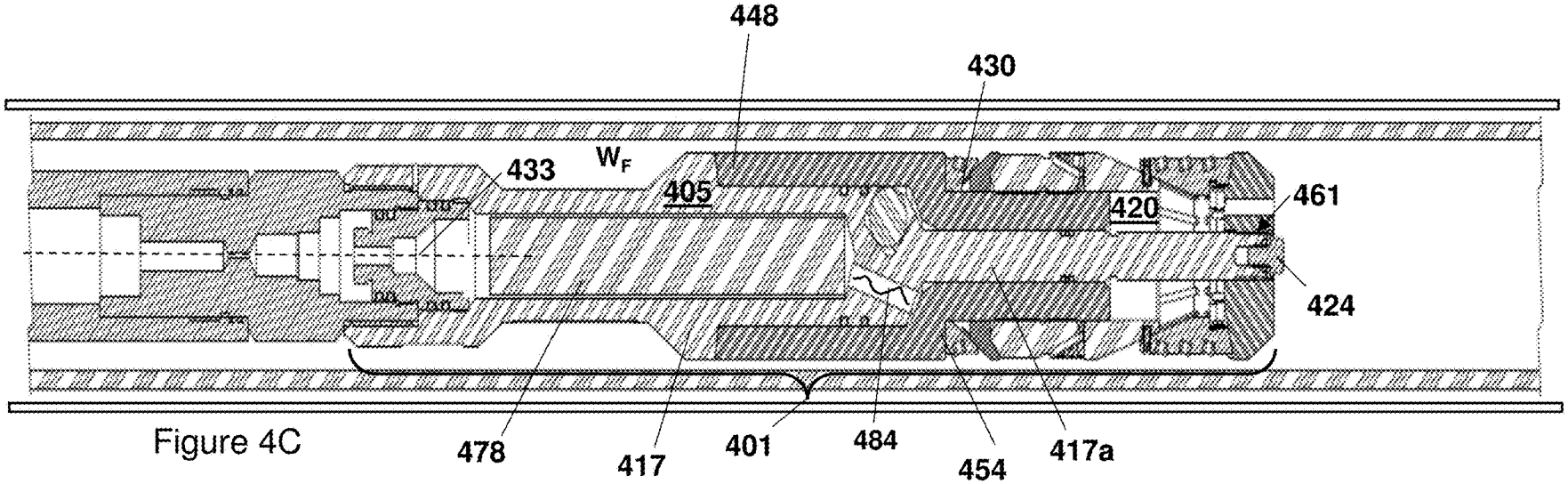
FIG. 4C shows a longitudinal side cross-sectional view of a completion assembly in a run-in configuration according to embodiments of the disclosure.

Referring now to FIGS. 4A, 4B, 4C, 4D, and 4E together, an isometric view of a completion assembly useable in a wellbore, an isometric component breakout view of a downhole setting system having a completion assembly with a power charge mandrel and a downhole tool, a longitudinal side cross-sectional view of a completion assembly in a run-in configuration, a longitudinal side cross-sectional view of the completion assembly of FIG. 4C moved from the run-in configuration toward a set configuration, and a longitudinal side cross-sectional view of the completion assembly of FIG. 4C moved to a disconnected configuration, respectfully, in accordance with embodiments disclosed herein, are shown.

Completion assembly 401 may be run, set, and operated as described herein and in other embodiments (such as in System 200, 300, etc., and so forth), and as otherwise understood to one of skill in the art. Components of the completion assembly 401 may be arranged and disposed as described herein and in other embodiments, and as otherwise understood to one of skill in the art. Thus, the completion assembly 401 may be comparable or identical in aspects, function, operation, components, etc. as that of other embodiments disclosed herein. Similarities may not be discussed for the sake of brevity. The notable difference by way of example between assembly 301 and assembly 401 may be seen as a downhole tool of the assembly 401 may be anchored instead of free floating, whereas many other aspects similar or comparable, and readily apparent.

As shown, the system 400 may include a wellbore 406 formed in a subterranean formation 410 with a tubular 408 disposed therein. A workstring 412 may include the downhole completion assembly 401 coupled therewith. The assembly 401 may include a first sub or portion 405, and a second sub or portion 420. In aspects, the first sub 405 may be a retrievable sub, which may be pulled out of the wellbore 406 (retrieve direction R) once the second sub 420 is disconnected therefrom. It may be the case that at least one component of respective subs are disconnected from each other.

The second sub 420 may be or include any type of downhole tool, such as a frac plug. The completion assembly 401 may have another configuration, such as a disconnected configuration whereby the first sub 405 is disconnected from the second sub 420. The run-in configuration of the combination assembly 401 (or system 400) may include the first sub 305 coupled or engaged with the second sub 420.

Figure 4D:
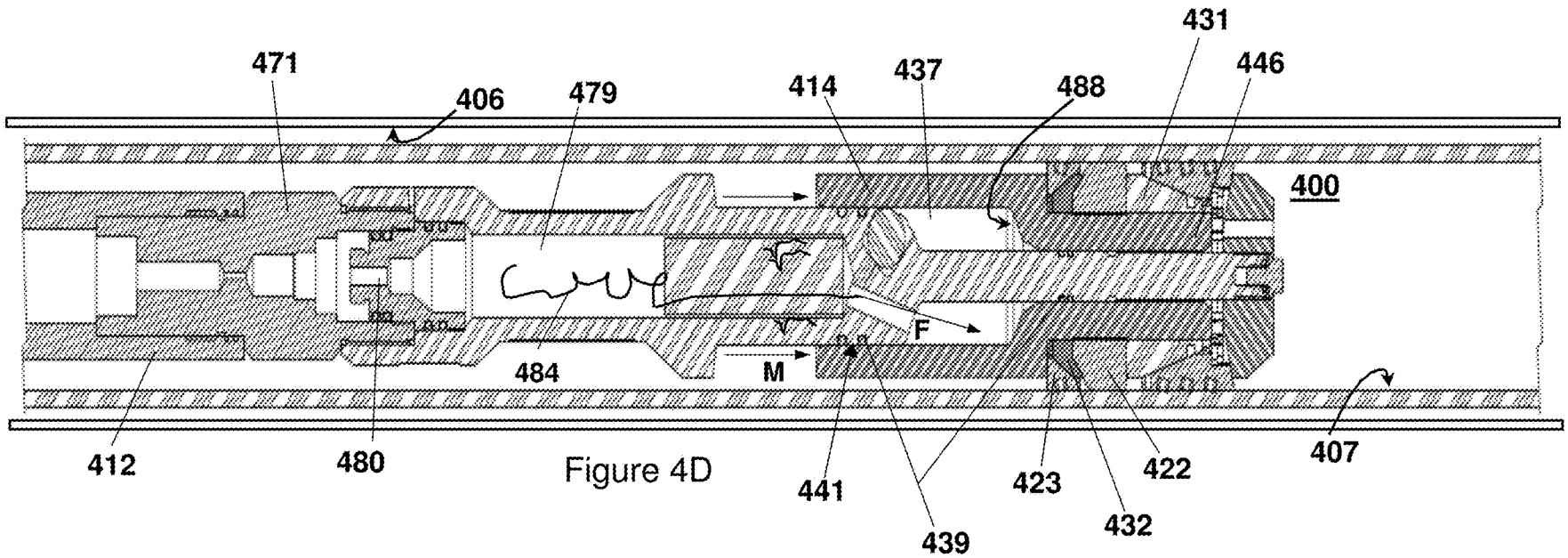
FIG. 4D shows a longitudinal side cross-sectional view of the completion assembly of FIG. 4C moved from the run-in configuration toward a set configuration according to embodiments of the disclosure.
Figure 4E:
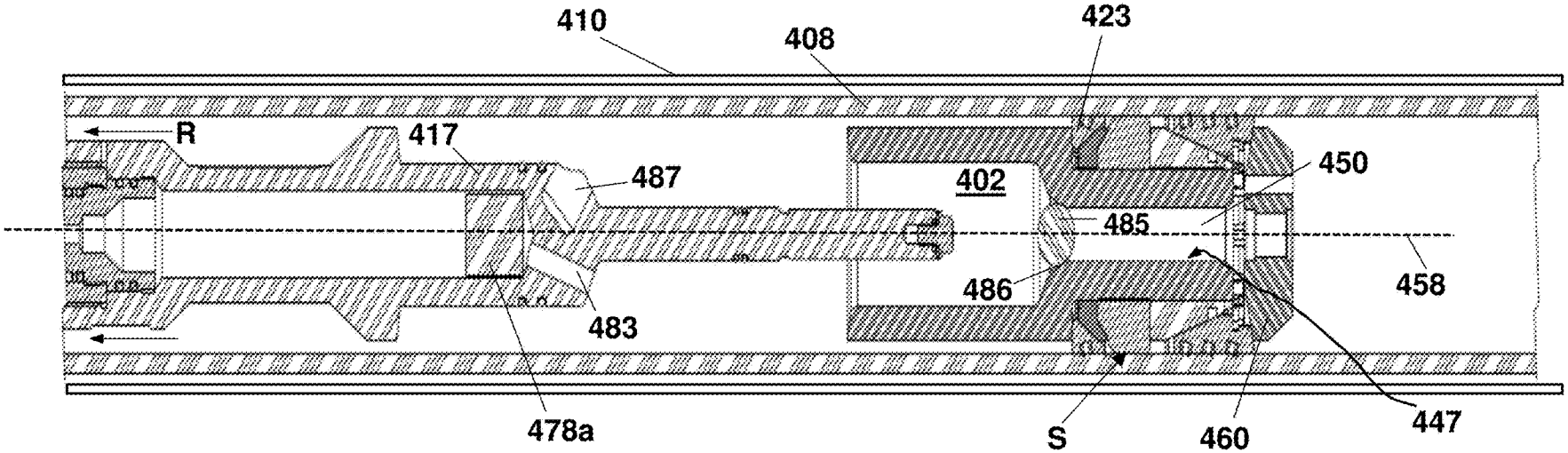
FIG. 4E shows a longitudinal side cross-sectional view of the completion assembly of FIG. 4C moved to a disconnected configuration according to embodiments of the disclosure.

FIGS. 4C-4E generally show a non-limiting representation of a temporal operational sequence whereby the completion assembly 401 undergoes a change in configuration(s). As one of skill in the art would appreciate, the completion assembly 401 may have the run-in configuration, as well as a second, set, connected (also, intermediate or stroke) configuration of FIG. 4D. The set configuration may include a transition aspect for the completion assembly 401.

The set configuration may include a range of position, such as from a beginning to set, to partial set, to fully set. As the completion assembly 401 moves from the run-in configuration to a (third) set, disconnected configuration, some amount of time will pass where the completion assembly undergoes stroke. In aspects, the fully set configuration may be (nearly) instantaneous to the set, disconnected configuration.

A mandrel 414 may extend through the tool (or tool body) 402 in the sense that components may be disposed therearound. The mandrel 414 may be a solid body. In other aspects, the mandrel 414 may include a flowpath or bore 450 formed therein (e.g., an axial bore generally in parallel to axis 458). The bore 450 may extend partially or for a short distance through the mandrel 414. Alternatively, the bore 450 may extend through the entire mandrel 414, with an opening at its proximate end 448 and oppositely at its distal end 446.

With the presence of the bore 450, the mandrel 414 may have an inner bore surface 447, which may include one or more mating surfaces formed thereon. As such, there may be a first mating or coupling such as a shear feature (e.g., threads). The coupling may be via other comparable mechanism(s), such as shear pin or the like.

The completion assembly 401 may be used to convey downhole tool 402 into wellbore 406 (such as within tubular 408) to a desired depth or position by way of the workstring 412. The assembly 401 may include a stroke mechanism, such as a power charge mandrel 417 (with firing head 471 and power charge 478) as part of system 400. The set position or configuration (see FIG. 4E) may include seal element 422 and/or slips (or rings) 434, 423 engaged with (the inner surface 407 of) the tubular 408.

One or more components of the downhole tool 402 may be coupled with, and axially and/or longitudinally movable along mandrel 414. When the stroke or setting sequence begins, the mandrel 414 may be pulled into tension (via connection with power charge mandrel end 417*a*). The lower sleeve 460 may be pulled as well because of its attachment to the mandrel 414 by virtue of coupling or shear feature 461.

As the lower sleeve 460 experiences setting forces (e.g., pulled), the components disposed about mandrel 414 between the lower sleeve 460 and mandrel shoulder 454 may begin to compress against one another. This force and resultant movement may cause compression and expansion of seal element 422. As the lower sleeve 460 is pulled further in tension toward the shoulder 454, the sleeve 460 may compresses against the slip 434. As a result, slip(s) 434 may move along a tapered or angled surface of a cone member 431, and eventually (radially) outward into engagement with the surrounding tubular 408 (and analogously with other or second ring or cone 432 and respective second slip or ring 423).

The slips 423, 434 may be configured with varied gripping elements (e.g., buttons or inserts) that may aid or prevent the slips (or tool) from moving (e.g., axially or longitudinally) upon engagement with the surrounding tubular 408. The second slip 423 may reside adjacent or proximate to the cone 432. As such, the seal element 422 may force or urge the cone 432 (and cone surface) directly or indirectly against the slip 423, moving the slip 423 (radially) outwardly into contact or engagement with the tubular 408. Similarly, the other cone 432 (and cone surface) may move against the slip 434 (and slip underside).

Accordingly, the one or more slips 423, 434 may be urged outward and into engagement with the tubular 308. As shown, the bottom or first slip 434 may be at or near distal end 446, and the second slip 423 may be disposed around the mandrel 414 at or near the proximate end 448. It is within the scope of the disclosure that the position of the slips 423 and 434 may be interchanged. For example, slip 423 may be the first or bottom slip, and slip 434 may be the second or top slip. Moreover, slip 434 may be interchanged with a slip comparable to slip 423, and vice versa.

The power charge mandrel 417 may have an inner charge bore 479 for which the power charge (or other comparable pyro-material) 478 may be disposed therein. A firing head 471 may have a corresponding firing head bore 480 suitable to provide a flame path for a respective flame or other igniting source to communicate to the inner charge bore 479 (and ultimately to the charge 478). The firing head 471 and other portions of the workstring 412 may be only shown in brevity. One of skill would appreciate conventional components usable for operation of the firing head and igniting of the power charge 478 may be used, even if not shown here. The power charge 478 may be like that of other power charge(s) described herein (e.g., 278).

The power charge 478 may be of a sufficient amount to have burn time to create sufficient pressure for setting and disconnect of the tool 402 (see FIG. 4D). For example, the amount of pressure within primary pressure chamber 437 upon burning of the power charge 478 may be about 7,500 psi to about 25,000 psi. After burning, the power charge 478 may reduce to a remnant power charge 478*a*, or may be burned in entirety.

Pressure may be generated within the inner charge bore 479 by the reaction as a result of forming gas. Gas 484 formed initially within the bore 479 may be fluidly communicated to the pressure chamber 437 via one or more ports 483 (of the power charge mandrel 417). In embodiments, there may be about 1 to about 15 ports 483. The ports 483 may be spaced symmetrically, asymmetrically, or combinations of both, with respect to each other. The ports 483 may be axial, radial, multi-direction, or as otherwise needed. Although not shown here, the ports 483 may have a longitudinal bore axis in parallel to a longitudinal tool axis 458.

As the gas 484 increases, expands, and moves into the primary chamber 437, it may act on a sleeve piston area, or working surface 488. The (annular) surface 488 may be the (approximate) working surface to which the pressure (and thus force) is applied. Although not limited to any particular shape or size, the working movable surface 488 may have, for example, a surface area in a range of about 4 square inches to about 7 square inches.

Ultimately the pressure within the chamber 437 may increase to a first preliminary or pre-determined (or also first actuation) force that results in movement of components along the mandrel 414. Continuing of the increase in pressure within the chamber 437 ultimately results in the tool 402 moved to the set configuration, and eventually a disconnected or third configuration (see FIG. 4E).

Referring now to FIGS. 5A, 5B, 5C, 5D, and 5E together, an isometric view of a completion assembly useable in a wellbore, an isometric component breakout view of a downhole setting system having a completion assembly with a power charge mandrel and a downhole tool, a longitudinal side cross-sectional view of a completion assembly in a run-in configuration, a longitudinal side cross-sectional view of the completion assembly moved from the run-in configuration toward a set configuration, and a longitudinal side cross-sectional view of the completion assembly moved to a disconnected configuration, respectfully, in accordance with embodiments disclosed herein, are shown.

Completion assembly 501 may be run, set, and operated as described herein and in other embodiments (such as in System 200, 300, etc., and so forth), and as otherwise understood to one of skill in the art. Components of the completion assembly 501 may be arranged and disposed as described herein and in other embodiments, and as otherwise understood to one of skill in the art.

The completion assembly 501 may be comparable or identical in aspects, function, operation, components, etc. as that of other embodiments disclosed herein. Similarities may not be discussed for the sake of brevity. The notable difference between assembly 301 and assembly 501 may be seen as a downhole tool of the assembly 501 may be anchored instead of free floating, whereas many other aspects similar or comparable, and readily apparent. While not limited, the downhole tool 502 may be 'top set' (instead of bottom set as shown by way of example for tool 402).

As shown, the system 500 may include a wellbore 506 formed in a subterranean formation 510 with a tubular 508 disposed therein. A workstring 512 may include a downhole completion assembly 501 coupled therewith. The assembly 501 may include a first sub or portion 505, and a second sub or portion 520. In aspects, the first sub 505 may be a retrievable sub, which may be pulled out of the wellbore 506 (retrieve direction R) once the second sub 520 is disconnected therefrom. The completion assembly 501 may include at least one component of the first sub 505 disconnected from at least one component of the second sub 520, such that the first sub 505 may be retrievable out of the wellbore 506, whereas one or more components of the second 520 need not be retrieved out of the wellbore 506.

The second sub 520 may be or include any type of downhole tool, such as a frac plug. The completion assembly 501 may have another configuration, such as a disconnected configuration whereby the first sub 505 is disconnected from the second sub 520. The run-in configuration of the combination assembly 501 (or system 500), whereby the first sub 505 may be coupled or engaged with the second sub 520.

Figures 5A, 5B:
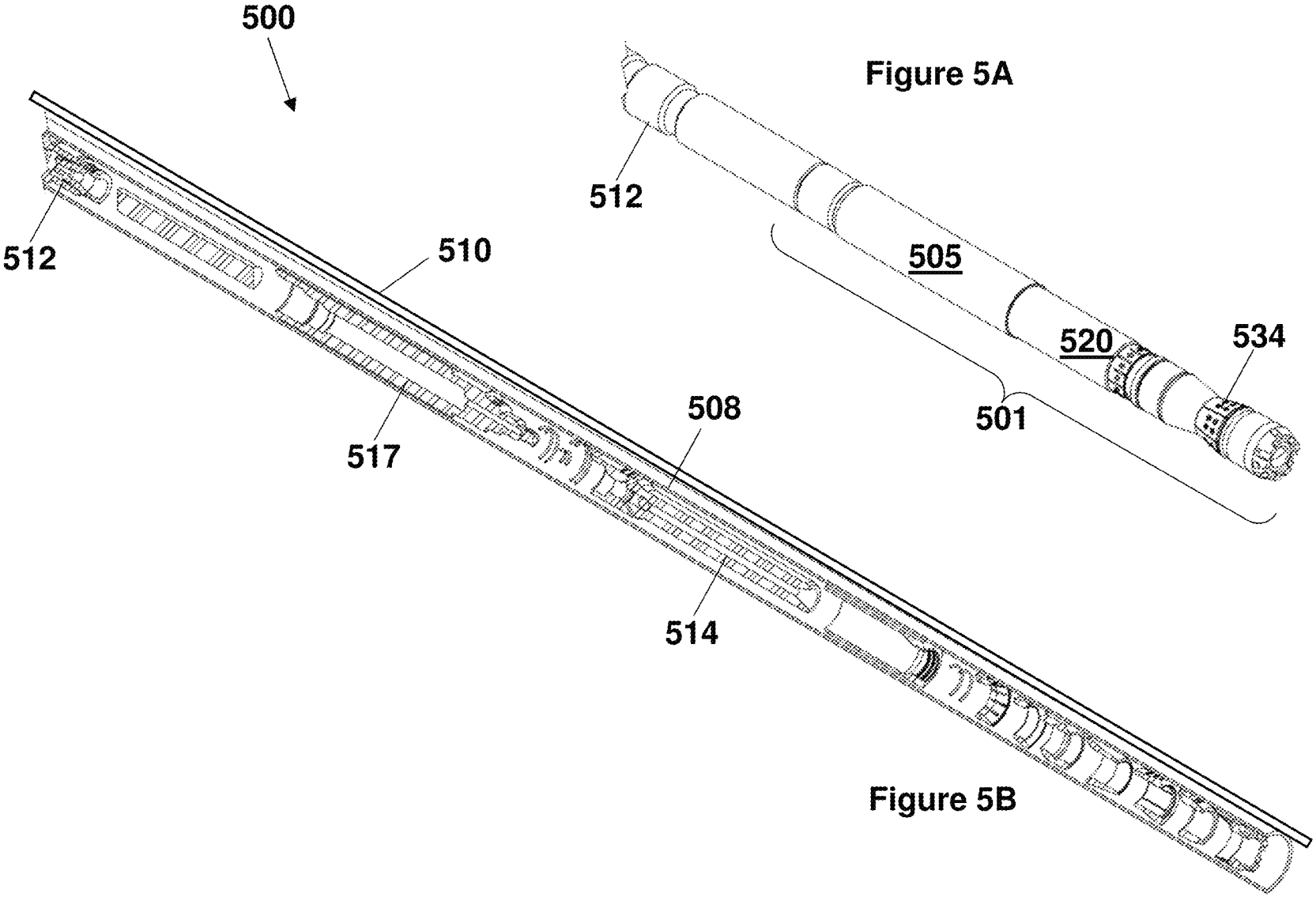
FIG. 5A shows an isometric view of a completion assembly useable in a wellbore according to embodiments of the disclosure.
FIG. 5B shows an isometric component breakout view of a downhole setting system having a completion assembly with a power charge mandrel and a downhole tool according to embodiments of the disclosure.
Figure 5C:
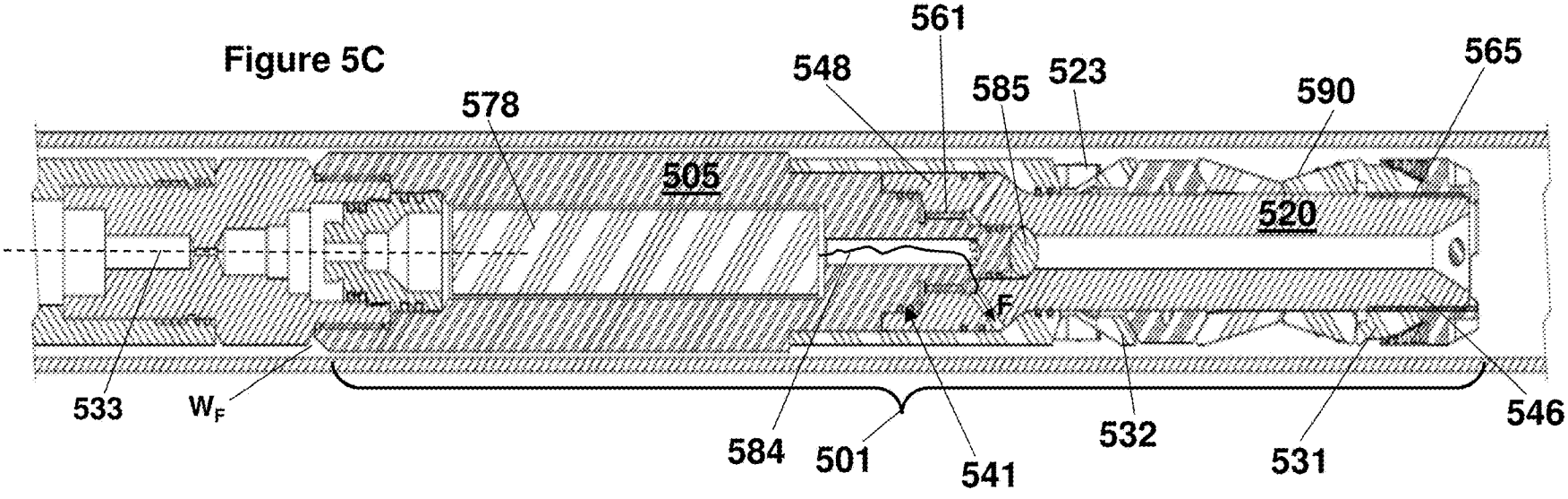
FIG. 5C shows a longitudinal side cross-sectional view of a completion assembly in a run-in configuration according to embodiments of the disclosure.
Figure 5D:
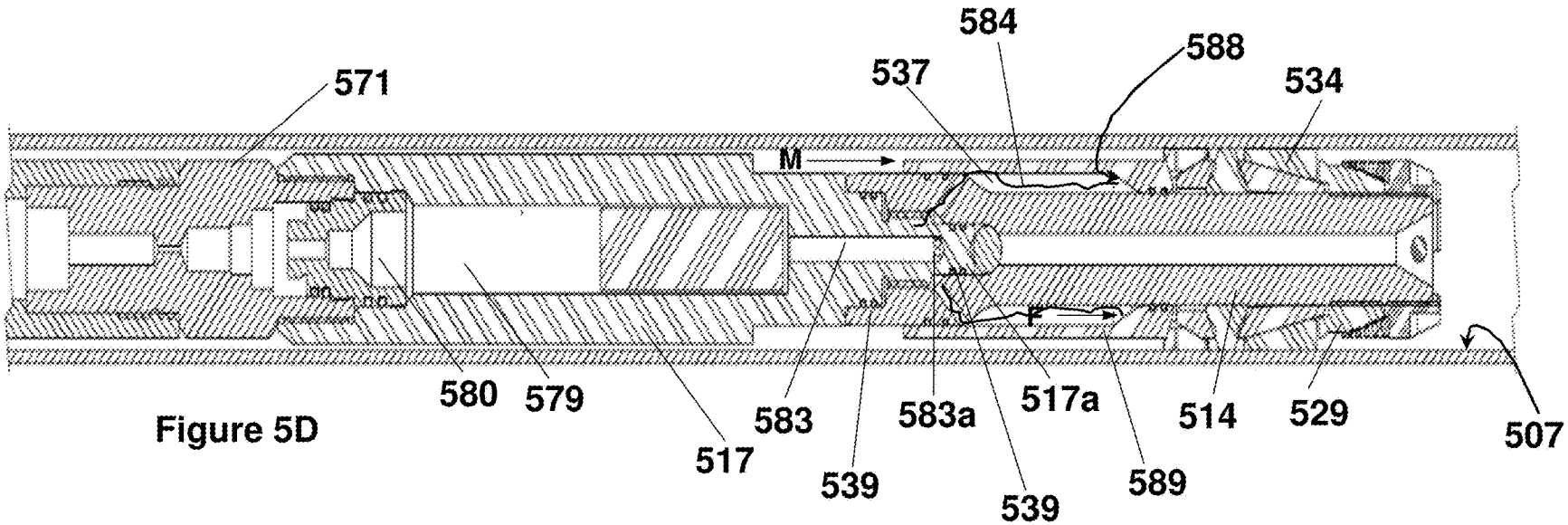
FIG. 5D shows a longitudinal side cross-sectional view of the completion assembly of FIG. 5C moved from the run-in configuration toward a set configuration according to embodiments of the disclosure.
Figure 5E:
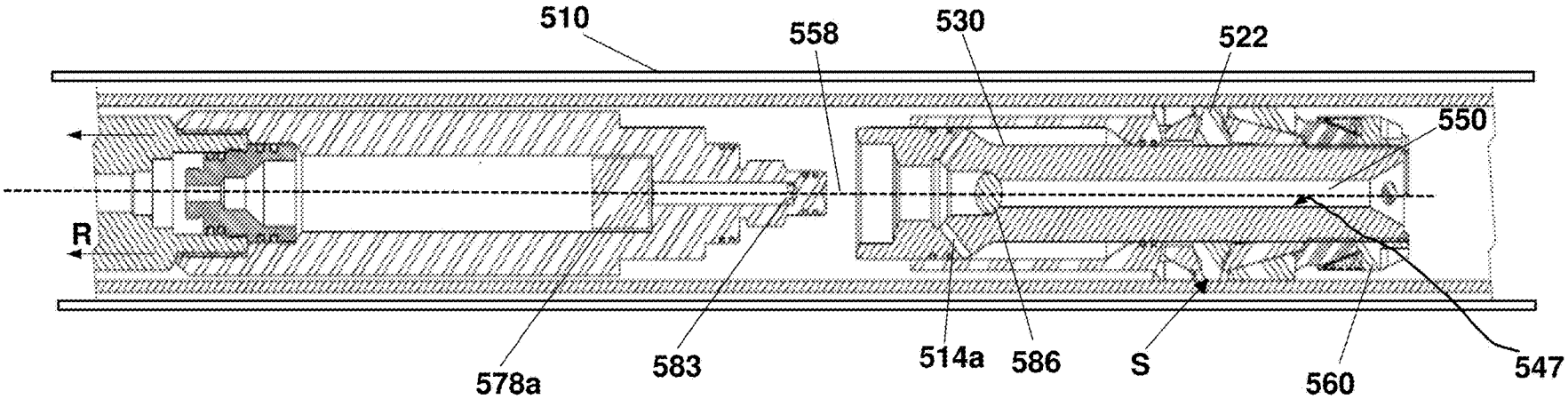
FIG. 5E shows a longitudinal side cross-sectional view of the completion assembly of FIG. 5C moved to a disconnected configuration according to embodiments of the disclosure.

FIGS. 5C-5E generally show a non-limiting representation of a temporal operational sequence whereby the completion assembly 501 undergoes a change in configuration(s). As one of skill in the art would appreciate, the completion assembly 501 may have the run-in configuration, as well as a second, set, connected (also, intermediate or stroke) configuration of FIG. 5D. The set configuration may include a transition aspect for the completion assembly 501. The set configuration may include a range of position, such as from a beginning to set, to partial set, to fully set. As the completion assembly 501 moves from the run-in configuration to a (third) set, disconnected configuration, some amount of time will pass where the completion assembly undergoes stroke. In aspects, the fully set configuration may be (nearly) instantaneous to the set, disconnected configuration.

A mandrel 514 may extend through the tool (or tool body) 502 in the sense that components may be disposed therearound. The mandrel 514 may be a solid body. In other aspects, the mandrel 514 may include a flowpath or bore 550 formed therein (e.g., an axial bore). The bore 550 may extend partially or for a short distance through the mandrel 514. Alternatively, the bore 550 may extend through the entire mandrel 514, with an opening at its proximate end 548 and oppositely at its distal end 546.

With the presence of the bore 550, the mandrel 514 may have an inner bore surface 347, which may include one or more mating (e.g., threaded) surfaces formed thereon. As such, there may be a first mating or shear feature 561 configured for the coupling of the mandrel 514 with a power charge mandrel 517. The coupling may be via other comparable mechanism(s), such as shear pin or the like.

To facilitate embodiments herein there may beneficially be a non-metallic 'bottom' or 'first' slip 534, and particularly, may be made filament wound composite material. The slip 534 may include an angled outer surface 590 ('angled' or offset with respect to a reference, such as axis 558). The outer surface 590 may be respective to one or more respective slip segments associated therewith, and/or more generally the entire effective outer surface.

Any slip segment of the slip may have a respective outer surface 590 (with related plane in cross-section). The (respective) plane may bisect the (longitudinal) axis 558 of the downhole tool 502 at an angle. The angle may be greater than one degree. In embodiments the angle may be in the range of 10 degrees to 20 degrees. The angle may move to zero or parallel as the slip 534 engages the tubular 508 (compare FIG. 5C to 5D).

It is within the scope of the disclosure that although shown or contemplated as a one-piece slip, other embodiments remain possible, such as a multi-segmented slip (which may be held together by a band or ring), and thus not one-piece.

The downhole tool 502 may be run into wellbore 506 (such as within tubular 508) to a desired depth or position by way of the workstring 512 that may be configured with the setting device or mechanism, such as the power charge mandrel 517 (with firing head 571 and power charge 578) and thus part of an overall system 500. The system 500 may include the workstring 512 with first sub 505 (and charge mandrel 517) utilized to run the second sub 320 (with the downhole tool 502 into the wellbore 506. The system 500 may be operable to activate the tool 502 to move from an unset or run-in (or first) configuration (see FIG. 5C/5D) to a set (or second) configuration.

The set position or configuration (see FIG. 5D/5E) may include seal element 522 and/or slips 534, 523 engaged with (the inner surface 507 of) the tubular 508. In an embodiment, a bearing ring 589 associate with the second sub 320 may be utilized to facilitate force or urge compression of the seal element 522, as well as swelling of the seal element 522 into sealing engagement with the surrounding tubular 508.

Components of the downhole tool 502 may be coupled with, and axially and/or longitudinally movable along mandrel 514. When the setting sequence begins, the mandrel 514 may be pulled into tension (via connection with power charge mandrel end 517*a*) while the bearing ring 589 may urge against tool components. The lower sleeve 560 may be pulled as well because of its attachment to the mandrel 514 by virtue of a lower end coupling (threads, pins, etc.) 565.

As the lower sleeve 560 experiences setting forces (e.g., pulled), the components disposed about mandrel 514 between the lower sleeve 560 and the bearing ring 589 may begin to compress against one another. This force and resultant movement may cause compression and expansion of seal element 522. As the lower sleeve 560 is pulled further in tension toward the bearing ring 589, the sleeve 560 may compresses against the slip 534. As a result, slip(s) 534 may move along a tapered or angled surface of a cone member 531, and eventually (radially) outward into engagement with the surrounding tubular 508 (and analogously with other or second cone 532 and respective second slip 523).

The slips 523, 534 may be configured with varied gripping elements (e.g., buttons or inserts) that may aid or prevent the slips (or tool) from moving (e.g., axially or longitudinally) within the surrounding tubular upon engagement. Although not limited, the downhole tool 502 may be anchored against the surface 507 in the disconnected configuration. The time the downhole tool 502 may be left in the wellbore may be for any duration as desired. Typically, the upper or second slip 523 may fracture first before the bottom or first slip 523. As shown, the bottom or first slip 534 may be at or near distal end 546, and the second slip 523 may be disposed around the mandrel 514 at or near the proximate end 548.

The power charge mandrel 517 may have an inner charge bore 579 for which the power charge (or other comparable pyro-material) 578 may be disposed therein. A firing head 571 may have a corresponding firing head bore 580 suitable to provide a flame path for a respective flame or other igniting source to communicate to the inner charge bore 579 (and ultimately to the charge 578).

The firing head 571 and other portions of the workstring 512 may be only shown in brevity. One of skill would appreciate conventional components usable for operation of the firing head and igniting of the power charge 578 may be used, even if not show or described here. The power charge 578 may be like that of other power charge(s) described herein (e.g., 278). The power charge 578 may be of a sufficient amount to have burn time to create sufficient pressure within primary pressure chamber 537 for setting and disconnect of the tool 502. Once burned, there may be a remnant power charge 578*a*.

Fluid pressure F may be generated within the inner charge bore 579 by the reaction as a result of forming gas 584. The gas 584 formed initially within the bore 579 may be fluidly communicated to the pressure chamber 537 via one or more ports 583 or side ports 583*a* (of the power charge mandrel 517). In embodiments, there may be about 1 to about 15 ports 583, 583*a*. The ports may be spaced symmetrically, asymmetrically, or combinations of both, with respect to each other. The ports may be axial, radial, multi-direction, or as otherwise needed. The port 583 may have a longitudinal bore axis in parallel to a longitudinal tool axis 558, whereas the port 583*a* need not be parallel.

The ports 583, 583*a* may be in fluid communication with mandrel port 514*a*, any or all of which may also be in fluid communication with a first or primary pressure chamber 537. As the gas 584 increases, expands, and moves into the primary chamber 537 (via the ports), it may act on a sleeve piston area, or working surface, 588. The working surface 588 may be associated with the bearing ring 589. The (annular) surface 588 may be the (approximate) working surface to which the pressure (and thus force) is applied.

As the gas 584 imparts a push in the direction of movement arrow M (or alternatively, the mandrel 514 urged in the opposite direction), one or more the components may begin to compress or urge against one another.

Ultimately the pressure within the chamber 537 may increase to a first preliminary or pre-determined (or also first actuation) force that moves components along the mandrel 514 (e.g., transition from view of FIG. 5C to 5D). Continuing of the increase in pressure within the chamber 537 ultimately results in the tool 502 moved to the set configuration, and eventually a disconnected or third configuration (e.g., transitioning from view of FIG. 5D to 5E).

It may be the case that the mandrel 514 may be configured with a plug seat 586 formed or removably disposed therein. In some embodiments, the plug seat 586 may be integrally formed within the bore 550 of the mandrel 514. The plug seat 586 may be used to seat any type of plug or isolation device, such as a ball or a flapper. In other embodiments, the seat 586 may be separately or optionally installed within the mandrel 514, as may be desired.

The ball seat 586 may be configured in a manner so that a ball or other form of plug/obstruction 585 may seat or rest therein, whereby the flowpath through the mandrel 514 may be closed off (e.g., flow through the bore 550 is restricted or controlled by the presence of the plug). In operation, fluid flow from one direction may urge and hold the plug 585 against the seat 586, whereas fluid flow from the opposite direction may urge the plug 585 off or away from the seat 586. As such, the plug 585 be used to prevent or otherwise control fluid flow through the tool 502.

It follows then that one or more components of any tool embodiment disclosed herein may be made of reactive materials (e.g., materials suitable for and are known to dissolve, degrade, etc. in downhole environments [including extreme pressure, temperature, fluid properties, etc.] after a brief or limited period of time (predetermined or otherwise) as may be desired). In an embodiment, a component made of a reactive material may begin to react within about 3 to about 48 hours after setting of the downhole tool 202.

One or more components of any tool embodiment disclosed herein may be made of a metallic material, such as an aluminum-based or magnesium-based material. The metallic material may be reactive, such as dissolvable, which is to say under certain conditions the respective component(s) may begin to dissolve, and thus alleviating the need for drill thru. These conditions may be anticipated and thus predetermined. In embodiments, the component(s) may be made of dissolvable aluminum-, magnesium-, or aluminum-magnesium-based (or alloy, complex, etc.) material.

One or more components of any tool embodiment disclosed herein may be made of non-dissolvable materials (e.g., materials suitable for and are known to withstand downhole environments [including extreme pressure, temperature, fluid properties, etc.] for an extended period of time (predetermined or otherwise) as may be desired).

Other non-limiting component materials may be used, such as plastic material, corrodible material, cast iron, and so forth.

Although not shown here, any tool embodiment disclosed herein may have a pumpdown ring or other suitable structure to facilitate or enhance run-in. For example, there may be a 'composite member' like that described in U.S. Pat. No. 8,955,605, incorporated by reference herein in its entirety for all purposes, particularly as it pertains to the composite member.

Any pressure chamber of any embodiment herein may be dynamic in that the associated space or volume associated therewith may change depending on operation.

Any pressure chamber of any embodiment may be an atmospheric pressure chamber. For example, when a device is assembled at the surface, fluid at atmospheric pressure may be captured and maintained at atmospheric pressure conditions unless and until the integrity of the chamber is lost.

Any completion assembly of the disclosure may have one or more pressure chambers, which may be isolated (and thus integrity maintained) while the assembly is in the run-in configuration. Integrity may be maintained, by way of example, but utilizing one or more sealing members or other type of closure.

Any completion assembly of the disclosure may be pre-assembled at any location, such as onsite at the wellhead or in shop.

Any completion assembly of the disclosure may completely lack or be void of any kind of conventional setting tool component, such as one or more of a barrel piston, a setting tool adapter (or adapter kit), and/or a setting sleeve, separately or in combination. Thus, although any completion assembly of the disclosure may have a setting mechanism, the setting mechanism includes using a working surface associated with a downhole tool.

Any completion assembly of the disclosure may have a working surface that is not retrieved to the surface. The working surface may remain in the wellbore for any period of time, as would be otherwise known and associated with an operable downhole tool (for example, a frac plug).

Remarks and description of any embodiment herein may analogously apply to any other embodiment. For example, general remarks associated with system 200 may apply to any system embodiment of the disclosure.

Advantages.

Embodiments herein may advantageously eliminate traditional multi-part wireline setting tools. In accordance with the disclosure, embodiments may provide for a simpler design with any plug subject to pre-assembly prior to site use. Therefore, any tool described herein may be sent to the field pre-assembled. A traditional wireline setting tool needs to be taken apart and redressed in the field after every plug run, and then a new plug installed before each trip down hole. Embodiments herein may eliminate the need to redress any tools between runs (reducing man hours) and since the only thing that comes out of hole is a static mandrel, it can be easily removed from the BHA (Bottom Hole Assembly) and a new pre-assembled completion assembly can be (re) attached. (Charge) mandrels may be returned to a shop for redress/reuse or disposed of.

Embodiments herein may provide for a working surface integrated or part of any type of plug or set downhole tool. This means downhole tools may be much shorter and lighter than as compared to when a traditional wireline setting tool is used. Since the completion assembly may be shorter, more guns (of other equipment) can be added to the workstring without making it longer. This allows more perforations between stages or a shorter distance between stages.

While preferred embodiments of the disclosure have been shown and described, modifications thereof can be made by one skilled in the art without departing from the spirit and teachings of the disclosure. The embodiments described herein are exemplary only, and are not intended to be limiting. Many variations and modifications of the disclosure disclosed herein are possible and are within the scope of the disclosure. Where numerical ranges or limitations are expressly stated, such express ranges or limitations should be understood to include iterative ranges or limitations of like magnitude falling within the expressly stated ranges or limitations. The use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, and the like.

Accordingly, the scope of protection is not limited by the description set out above but is only limited by the claims which follow, that scope including all equivalents of the subject matter of the claims. Each and every claim is incorporated into the specification as an embodiment of the present disclosure. Thus, the claims are a further description and are an addition to the preferred embodiments of the present disclosure. The inclusion or discussion of a reference is not an admission that it is prior art to the present disclosure, especially any reference that may have a publication date after the priority date of this application. The disclosures of all patents, patent applications, and publications cited herein are hereby incorporated by reference, to the extent they provide background knowledge; or exemplary, procedural or other details supplementary to those set forth herein.

What is claimed is:

1. A completion assembly for use in a wellbore, the completion assembly comprising:

a power charge mandrel configured to engage with a workstring, the power charge mandrel comprising:

a power charge bore; and a power charge disposed within the power charge bore in a run-in configuration;

a downhole tool proximate to the power charge mandrel in the run-in configuration, the downhole tool comprising:

a mandrel further comprising: a distal end; a proximate end; an inner flowbore; and an outer surface, the mandrel in sealing engagement with the power charge mandrel in the run-in configuration;

wherein in the run-in configuration the completion assembly is configured to maintain pressure integrity of a primary pressure chamber disposed in direct proximity to a working surface associated with a component of the downhole tool, wherein during a setting sequence at least a portion of the power charge mandrel is in fluid communication with the primary pressure chamber, and also during the setting sequence the mandrel, or another component, is configured with a working surface in fluid communication with the power charge bore, wherein the power charge is ignitable to create or increase an inner fluid pressure that is conveyed from the power charge bore to the working surface, wherein the inner fluid pressure acting on the working surface results in a force that changes a volume dimension associated with the atmospheric pressure chamber, wherein the force is sufficient such that the power mandrel sealingly disengages from the mandrel in a disconnected configuration, wherein in the disconnected configuration the working surface remains in the wellbore for a period of time after the power charge mandrel is retrieved out of the wellbore, and wherein the completion assembly further comprises an isolation device disposed at least partially within or in direct proximity to the primary pressure chamber in the run-in configuration.

2. The completion assembly of claim 1, wherein a mating feature is used for engagement of the power charge mandrel, or a component coupled therewith, with the downhole tool in the run-in configuration, and wherein in the disconnected configuration the mating feature is disrupted or broken.

3. The completion assembly of claim 1, wherein in the disconnected configuration an at least a portion of the downhole tool and the working surface remains in the wellbore for an at least an amount of time associated with an at least one downhole operation that occurs after the power charge mandrel is retrieved out of the wellbore.

4. The completion assembly of claim 1, wherein in the run-in configuration the completion assembly comprises a second pressure chamber maintained at a respective pressure that is isolated from any external wellbore pressure as the completion assembly is run into the wellbore.

5. The completion assembly of claim 1, wherein in the run-in configuration the primary pressure chamber is fluidly isolated from any external wellbore fluid.

6. The completion assembly of claim 1, wherein in the run-in configuration the completion assembly is void of any of: a setting tool adapter or adapter kit, a barrel piston, a setting sleeve, and combinations thereof.

7. The completion assembly of claim 1, wherein in each of the run-in configuration, the disconnected configuration, and during the setting sequence, the power charge mandrel lacks any moving parts coupled thereto other than of the downhole tool.

8. The completion assembly of claim 7, wherein the completion assembly further comprises an isolation device seat disposed at least partially within or in direct proximity to the primary pressure chamber in the run-in configuration such that the isolation device seat is isolated from any external fluid pressure in the wellbore as the completion assembly is run into the wellbore.

9. A completion assembly for use in a wellbore, the completion assembly comprising:

a power charge mandrel comprising:

a power charge bore;

a power charge disposed within the power charge bore in a run-in configuration;

a downhole tool proximate with the power charge mandrel in the run-in configuration, the downhole tool comprising:

a mandrel comprising: a distal end; a proximate end; an inner flowbore; and an outer surface;

wherein in the run-in configuration an at least a portion of the downhole tool is configured to maintain integrity of an atmospheric pressure chamber disposed at least partially within the downhole tool, wherein in the run-in configuration the atmospheric pressure chamber is fluidly isolated form any external fluid, wherein during a setting sequence the power charge mandrel is in fluid communication with the atmospheric pressure chamber, wherein the downhole tool comprises the mandrel, or another component, configured with a working surface in fluid communication with the power charge bore during the setting sequence, wherein the power charge is ignitable to create or increase an inner fluid pressure that is conveyed from the power charge bore to the working surface, wherein the inner fluid pressure acting on the working surface results in a force that changes a size of a volume dimension associated with the atmospheric pressure chamber, wherein at some point in time after the setting sequence commences the force is sufficient such that the completion assembly is in a disconnected configuration, wherein in the disconnected configuration the working surface remains in the wellbore for a period of time whereby an at least one downhole operation occurs after the power charge mandrel is retrieved out of the wellbore, wherein the completion assembly further comprises an isolation device and an isolation device seat disposed at least partially within or in proximity to the atmospheric pressure chamber in the run-in configuration such that the isolation device and the isolation device seat are both isolated from any external fluid as the completion assembly is run into the wellbore, and wherein the completion assembly is void of at least one of: a setting tool adapter or adapter kit, a barrel piston, a setting sleeve, and combinations thereof.

10. The completion assembly of claim 9, wherein a mating feature is used to engage one of the power charge mandrel, or another component, with the mandrel.

11. The completion assembly of claim 9, wherein the isolation device comprises a ball, and the isolation device seat comprises a ball seat.

12. The completion assembly of claim 9, wherein in the run-in configuration the power charge mandrel is in direct physical engagement with the mandrel.

13. The completion assembly of claim 11, wherein the at least one downhole operation comprises hydraulic fracturing.

14. The completion assembly of claim 13, wherein in the run-in configuration the completion assembly comprises a second pressure chamber maintained at a respective pressure that is isolated from any external fluid as the completion assembly is run into the wellbore, and wherein in the disconnected configuration the atmospheric pressure chamber and the second pressure chamber are no longer isolated from any external fluid.

15. The completion assembly of claim 9, wherein the isolation device comprises a ball, wherein the at least one downhole operation comprises hydraulic fracturing, and wherein the downhole tool comprises a frac plug.

16. A downhole setting system for use in a wellbore, the system comprising:

a completion assembly comprising:

a power charge mandrel engaged with a workstring;

a downhole tool comprising a component having a working surface, the component sealingly engaged with the power charge mandrel in a run-in configuration;

an inner pressure chamber formed between the working surface and another proximate surface of the completion assembly in the run-in configuration;

wherein in the run-in configuration the inner pressure chamber comprises a first pressure that is isolated from any external fluid pressure in the wellbore, wherein during a setting sequence the power charge mandrel is in fluid communication with the inner pressure chamber, wherein in a disconnected configuration the component is sealingly disengaged from the power charge mandrel, and the power charge mandrel and the another proximate surface is retrievable out of the wellbore, wherein in the disconnected configuration the working surface is not retrieved out of the wellbore, wherein the completion assembly further comprises an isolation device and an isolation device seat disposed at least partially within or in direct proximity to the inner pressure chamber in the run-in configuration such that the isolation device and the isolation device seat are also both isolated from any external fluid in the wellbore as the completion assembly is run into the wellbore.

17. The downhole setting system of claim 16, wherein in the run-in configuration the completion assembly is void of each of: a setting tool adapter or adapter kit, a barrel piston, a setting sleeve, and combinations thereof.

18. The downhole setting system of claim 16, wherein the power charge mandrel further comprises a power charge bore in fluid communication with the inner pressure chamber during the setting sequence, wherein a power charge is disposed in the power charge bore in the run-in configuration, and wherein the power charge is ignitable in a manner that results in an increase of the first pressure to a second pressure.

19. The downhole setting system of claim 18, wherein the second pressure is high enough to cause movement of the working surface in a manner that results in the completion assembly moved from the run-in configuration to the disconnected configuration.

20. The downhole setting system of claim 16, wherein the isolation device comprises a ball, wherein the component comprises a mandrel, wherein the downhole tool comprises a frac plug, and wherein in each of the run-in configuration, the disconnected configuration, and during the setting sequence, the completion assembly is void of a setting tool with at least one of: a movable sleeve, a movable piston, and combinations thereof.

* * * * *